US006817692B2

(12) United States Patent
Nakazawa et al.

(10) Patent No.: US 6,817,692 B2
(45) Date of Patent: Nov. 16, 2004

(54) INKJET RECORDING DEVICE AND RECORDING METHOD

(75) Inventors: Yusuke Nakazawa, Shizuoka-ken (JP); Koji Furukawa, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/607,250

(22) Filed: Jun. 27, 2003

(65) Prior Publication Data

US 2004/0001134 A1 Jan. 1, 2004

(30) Foreign Application Priority Data

Jun. 28, 2002 (JP) ..... 2002-189497
Nov. 29, 2002 (JP) ..... 2002-348164

(51) Int. Cl.[7] ..... B41J 29/38
(52) U.S. Cl. ..... 347/12; 347/104; 347/37
(58) Field of Search ..... 347/14, 19, 37, 347/65, 101, 104, 12, 100

(56) References Cited

U.S. PATENT DOCUMENTS 3,790,703 A * 2/1974 Carley ..... 347/100
5,124,720 A * 6/1992 Schantz ..... 347/19
6,070,970 A * 6/2000 Ogasawara et al. ..... 347/65
6,347,855 B1 * 2/2002 Takanaka ..... 347/12
6,470,799 B2 * 10/2002 Nakazawa et al. ..... 347/12
6,499,822 B1 * 12/2002 Abe et al. ..... 347/19

FOREIGN PATENT DOCUMENTS

| | | |
|---|---|---|
| JP | 48-8005 | 3/1973 |
| JP | 2-238948 | 9/1990 |
| JP | 2001-171103 | 6/2001 |
| JP | 2001-199071 | 7/2001 |
| JP | 2002-103598 | 4/2002 |

* cited by examiner

*Primary Examiner*—Eugene H. Eickholt
(74) *Attorney, Agent, or Firm*—Sughrue Mion, PLLC

(57) ABSTRACT

An inkjet recording device and inkjet recording method capable of forming a high quality image with a simple structure. A transport belt position detection component detects a position of an end portion of a transport belt and outputs the detected position to a system control section. A recording medium position detection component detects a position of an end portion of a recording medium and outputs the detected position to the system control section. A position control component is capable of moving on the basis of instructions from the system control section for movement across a transport direction.

16 Claims, 20 Drawing Sheets

INKJET RECORDING DEVICE AND RECORDING METHOD

CROSS-REFERENCE TO RELATED APPLICATION

This application claims priority under 35USC 119 from Japanese Patent Application Nos. 2002-189497 and 2002-348164, the disclosures of which are incorporated by reference herein.

BACKGROUND OF THE INVENTION

1. Field of the Invention

The present invention relates to an inkjet recording device and an inkjet recording method.

2. Description of the Related Art

As printing methods that form printed images on printing media on the basis of image data signals, there are electrophotographic techniques, sublimation-type and fusion-type thermal transfer techniques, inkjet techniques and the like. An electrophotographic technique requires a process for forming a static electricity latent image, by static charging and exposure of a photosensitive drum. A system therefor is complex, and an apparatus is expensive. With a thermal transfer technique, an apparatus is inexpensive but, because ink ribbons are used, running costs are high and waste is produced. In contrast, with an inkjet technique, direct printing is carried out on a recording medium at an inexpensive apparatus by discharging ink only at required imaging sections. Consequently, colorants can be utilized with high efficiency and running costs are inexpensive.

As printing technologies which employ inkjet techniques, there are, for example, a method which retains and transports a recording medium on a drum (see Japanese Patent Application Publication (JP-B) No. 48-8005), a method which nips and transports a recording medium at a capstan roller (see Japanese Patent Application Laid-Open (JP-A) No. 2001-171103), a method which retains and transports a recording medium on an endless belt (see JP-A Nos. 2-238948, 2001-199071 and 2002-103598) and the like. Of these, the method with transport of a recording medium using an endless belt is effective when printing is to be carried out at high speed. In particular, high-speed printing is made possible by matching up a recording medium with a fixed-type full-line head having a printing length the same as the width of the recording medium. However, when an endless belt is employed, width direction meandering of the belt causes deterioration in image quality. Accordingly, an improvement in which relative positions of a plurality of rollers around which the belt is stretched are altered to vary tension at two ends of the endless belt, forms of the rollers are optimized, and restoring force is applied to return the endless belt to its original position when the endless belt meanders is well known. However, in this case, high precision control is necessary when carrying out high-speed printing with high definition, which is technically difficult. Furthermore, when a full-line head is employed, the number of nozzles is large, head problems due to blockages of the nozzles, breakdowns and the like occur, and images deteriorate. In a case in which non-discharging nozzles occur, which is particularly difficult to rectify, replacement of the head itself is necessary, and productivity of the printing system is reduced to zero until replacement is complete.

SUMMARY OF THE INVENTION

The present invention has been devised in order to solve the problems described above, and an object of the present invention is to provide an inkjet recording device and inkjet recording method capable of forming high quality images using a simple structure.

An inkjet recording device of a first aspect of the present invention for achieving the object described above is a structure which includes: an image-forming component which discharges ink for forming an image on a recording medium; a transport belt which has the form of an endless belt and which retains the recording medium at a predetermined position and transports the recording medium in a longitudinal direction; a position detection component which detects at least one of a relative position of the endless belt with respect to the image-forming component in a width direction and a relative position of the recording medium with respect to the image-forming component; and an alteration component which changes a position of image formation by the image-forming component in accordance with the at least one detected relative position.

The image-forming component of the present invention discharges ink and forms an image on a recording medium. The image recording is carried out while the recording medium is conveyed in the longitudinal direction of the transport belt by this endless-type transport belt. Here, there is a possibility that discharge of the ink will not be carried out at proper positions when the transport belt is displaced from a predetermined position of the belt in the width direction. Accordingly, at least one of the relative position of the endless belt in the width direction relative to the image-forming component and the relative position of the recording medium relative to the image-forming component is detected by the position detection component. Hence, the position of image formation by the image-forming component is altered by the alteration component in accordance with the detected relative position.

A high quality image can be formed more simply by varying the position of image formation by the image-forming component as described above than in a case of carrying out positional control of the transport belt by altering tension of the transport belt itself so that a restoring force acts on the transport belt.

An inkjet recording device of a second aspect is a structure which includes: an image-forming component which includes a plurality of nozzles and which utilizes electrostatic fields based on image data signals to discharge oil-based ink from the plurality of nozzles for forming an image on a recording medium; and an interpolation processing component which, in a case in which defects in discharge of the ink occur at a portion of the plurality of nozzles, carries out interpolation processing such that image formation is carried out by other nozzles instead of the nozzles affected by the defects, the other nozzles being properly working nozzles.

The image-forming component of the present invention discharges ink from the plurality of nozzles and forms an image on a recording medium. Here, in the case in which defects in discharge of the ink occur at some of the plurality of nozzles, a portion of image formation corresponding to those nozzles is not properly formed, and a deterioration of the image is caused. Accordingly, in the case in which the defects in discharge of the ink at some of the plurality of nozzles occur, interpolation processing is implemented by the interpolation processing component such that image formation is carried out by other, properly working nozzles instead of those nozzles. Here, defects in discharge of the ink can mean failures to discharge ink, abnormalities in discharge amounts, and/or abnormalities in discharge directions.

According to the structure described above, because the interpolation processing component interpolates the image formation portion corresponding to the nozzles affected by the ink discharge defects, deterioration of formed images can be prevented without the nozzles themselves being replaced.

An inkjet recording device of a third aspect is a structure including: an image-forming component which forms an image on a recording medium by utilizing electrostatic fields to discharge oil-based ink on the basis of image data signals; a recording medium transport component which includes a belt form and an endless form and which retains and transports the recording medium; a position detection component which detects a position, in a width direction of the recording medium transport component, of at least one of the recording medium transport component and the recording medium which is retained at the recording medium transport component; and a position control component which controls a position of the image-forming component in the width direction of the recording medium transport component on the basis of the position detected by the position detection component.

According to the structure described above, the position of the image-forming component is controlled by the position control component on the basis of the position of the at least one of the recording medium transport component and the recording medium. Thus, a high quality image can be formed more simply than in a case of altering tension of the transport belt itself and applying restoring force to the transport belt to carry out positional control of the transport belt.

In this inkjet recording device, the image-forming component may include a plurality of nozzles disposed in a direction substantially intersecting a direction of transport of the recording medium, and image formation by this plurality of nozzles is carried out by main scanning in the direction of transport of the recording medium. Here, the direction substantially intersecting the direction of transport of the recording medium is a direction on a surface of the recording medium that substantially intersects the direction of transport of the recording medium.

Further, in this inkjet recording device, the plurality of nozzles may be disposed spanning from one end to another end of an image formation region in a sub-scanning direction. According to this structure, image formation can be carried out over the whole of the sub-scanning direction of the image formation region by a single cycle of main scanning, and image formation can be carried out rapidly.

Further still, the inkjet recording device may further include a discharge defect nozzle detection component which detects discharge defect nozzles, which are nozzles among the plurality of nozzles that have discharge defects, and the position control component may move the image-forming component such that image formation is carried out by properly working nozzles, which are free of discharge defects, instead of the discharge defect nozzles detected by the discharge defect nozzle detection component.

Hence, because it is possible to form images with the properly working nozzles instead of the discharge defect nozzles, deterioration of images that are formed can be prevented without replacing the nozzles themselves.

In this inkjet recording device, retention of the recording medium to the recording medium transport component may be implemented by an electrostatic component.

Further, in this inkjet recording device, the recording medium that is retained at the recording medium transport component may be peeled off by one or both of an electrostatic component and a mechanical component.

Further still, in this inkjet recording device, the oil-based ink may be an ink in which at least colored particles are dispersed in a non-aqueous solvent with a characteristic electrical resistivity value of at least $10^9$ Ω·cm and a relative dielectric coefficient of at most 3.5.

The inkjet recording device may further include an ink recovery component which recovers the oil-based ink from the image-forming component, and an ink supply component which supplies the oil-based ink that has been recovered by the ink recovery component to the image-forming component.

The inkjet recording device may further include a fixing component, which fixes the oil-based ink that has been discharged onto the recording medium.

A recording method using an inkjet recording device, of a fourth aspect of the present invention, includes the steps of: forming an image on a recording medium by discharging ink using an image-forming component; transporting the recording medium in a longitudinal direction of a transport belt, having retained the recording medium at a predetermined position of the transport belt; detecting at least one of a relative position of the transport belt relative to the image-forming component in a direction which intersects the longitudinal direction and a relative position of the recording medium relative to the image-forming component; and altering a position of image formation by the image-forming component in accordance with the detected relative position.

A recording method using an inkjet recording device, of a fifth aspect of the present invention, includes the steps of: forming an image on a recording medium by discharging oil-based ink from a plurality of nozzles using an electrostatic field on the basis of image data signals; and, in a case in which an ink discharge defect occurs at one or more of the plurality of nozzles, carrying out interpolation processing so as to substitute image formation by the nozzle at which the ink discharge defect has occurred with image formation by another of the nozzles.

A recording method using an inkjet recording device, of a sixth aspect of the present invention, includes the steps of: forming an image on a recording medium with an image-forming component by discharging oil-based ink using an electrostatic field on the basis of image data signals; transporting the recording medium in a longitudinal direction of a recording medium transport component, having retained the recording medium; detecting a position, in a direction intersecting the longitudinal direction of the recording medium transport component, of at least one of the recording medium transport component and the recording medium retained at the recording medium transport component; and, on the basis of the detected position, controlling a position of the image-forming component in the direction intersecting the longitudinal direction of the recording medium transport component.

As is described above, according to the inkjet recording device of the present invention, printed matter with clear, high quality images can be printed at high speed by a simple method. Further, an inkjet recording device can be provided which is reliable and whose productivity is not reduced to zero even when problems occur at a portion of nozzles at a head and that portion includes a large number of the nozzles.

Further still, according to the present invention, it is possible to print printed materials from different image information with clarity, low cost and high speed.

DETAILED DESCRIPTION OF THE INVENTION

Herebelow, an embodiment of the present invention will be described in detail.

The present invention applies to inkjet recording devices, but is particularly favorably applied to formation of an image on a recording medium, which is supplied to an inkjet recording device, by an inkjet technique, which discharges oil-based ink using an electrostatic field. Here, an example of an inkjet recording device utilizing this form will be described.

Because the inkjet technique relating to the present invention employs oil-based ink, cockling of paper due to ink absorption, as with aqueous ink, does not occur, and there are fewer constraints on the recording medium. In addition, by employing an oil-based ink, which contains charged colored particles, the colored particles can be discharged at a higher density, and a clear, high-density image, which is free of ink-smearing, is formed. Thus, a high-definition image can be formed by image formation not only on dedicated inkjet paper but also on usual offset printing paper and plastic films.

A structural example of an inkjet recording device to which the present invention is applied is illustrated below. Note that the present invention is not limited to the following structural example.

Figure 1:
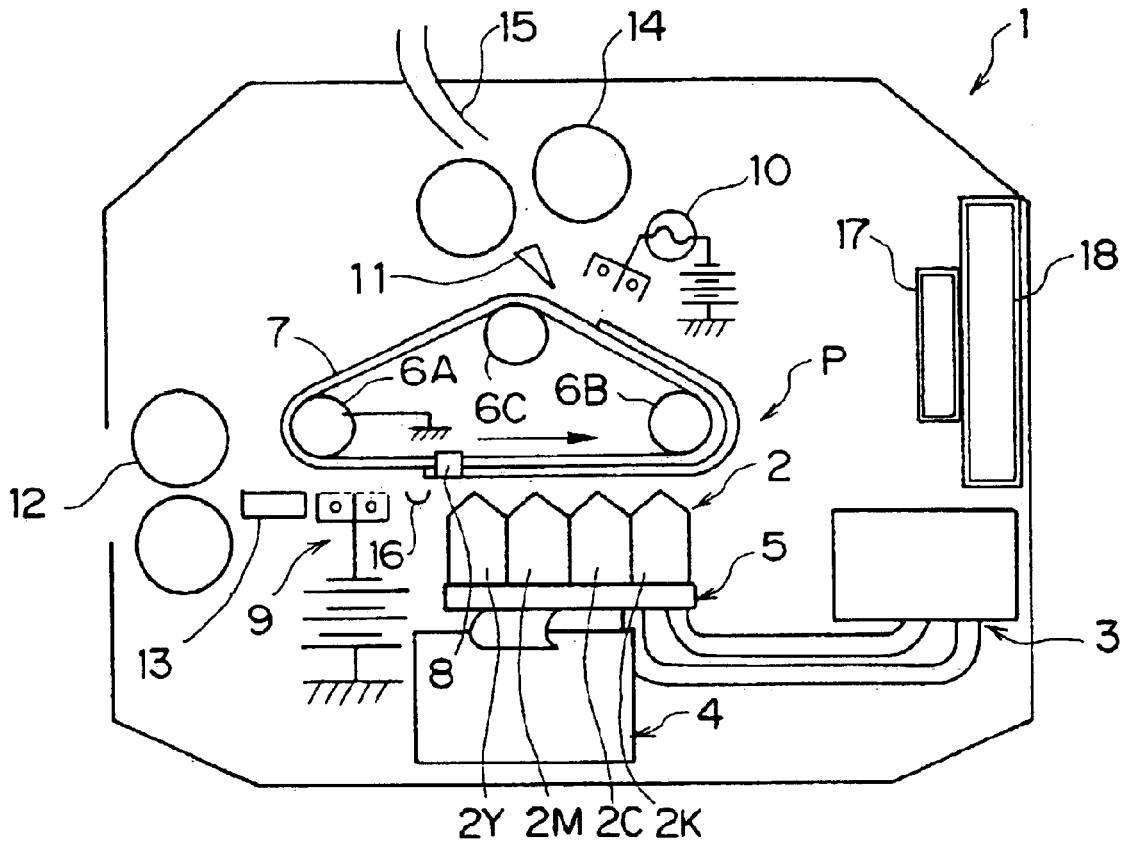
FIG. 1 is an overall structural diagram schematically showing an example of an inkjet printing device, which utilizes the present invention.
Figure 2:
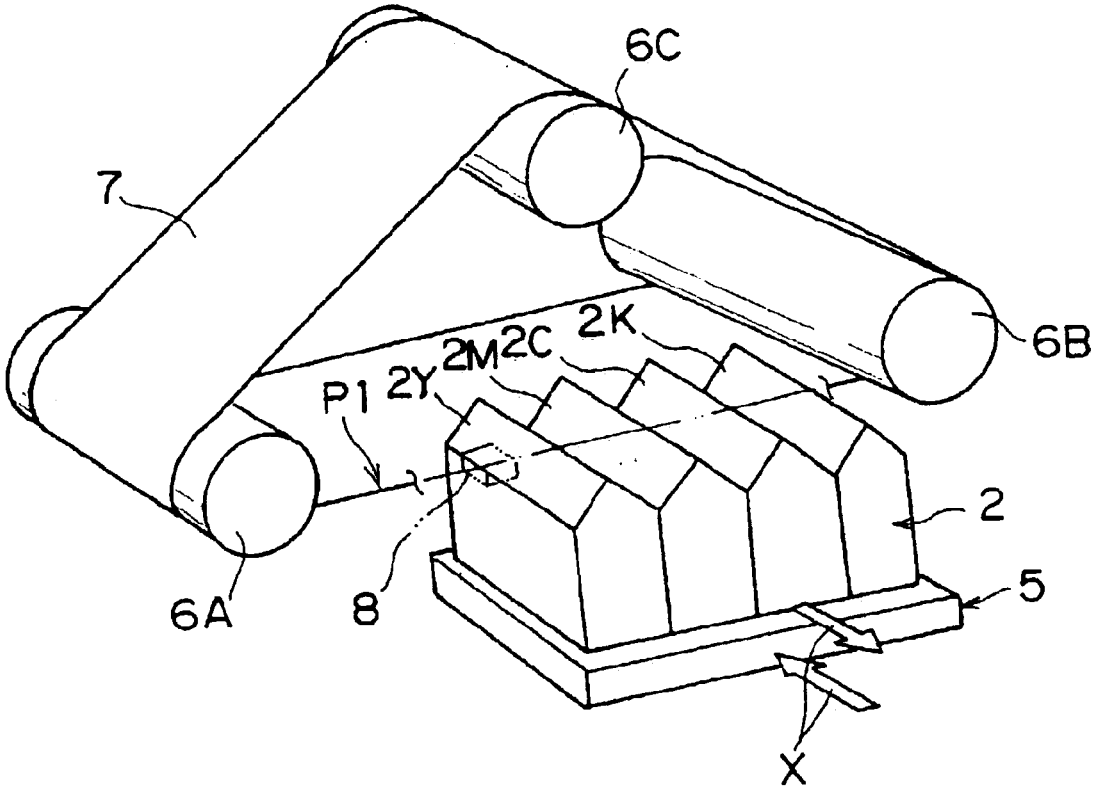
FIG. 2 is a schematic diagram for explaining the main elements of the device of FIG. 1.

First, general details of a device, which is shown in FIGS. 1 and 2, for carrying out single-sided four-color printing on a recording medium will be described.

As shown in FIG. 1, an inkjet recording device 1 is provided with a circulation system 3, a head driver 4 and a position control component 5. The circulation system 3 supplies ink to a discharge head 2 and recovers ink from the discharge head 2. The discharge head 2 is structured by discharge heads of four colors, discharge heads 2C, 2M, 2Y and 2K, for carrying out four-color image formation. The head driver 4 drives the discharge head 2 in accordance with output from external equipment such as a computer, an RIP or the like. The inkjet recording device 1 is also provided with a transport belt 7, a transport belt position detection component 8, an electrostatic adsorption component 9, an electrostatic elimination component 10 and a mechanical component 11. The transport belt 7 is stretched between three rollers 6A, 6B and 6C. The transport belt position detection component 8 is structured with an optical sensor, which is capable of detecting a position of the transport belt 7 in a width direction thereof or the like. The electrostatic adsorption component 9 is for retaining a recording medium P on the transport belt. The electrostatic elimination component 10 and mechanical component 11 are for peeling off the recording medium P from the transport belt 7 after image formation has been completed. A guide 13 and a feed roller 12, which supply the recording medium to the transport belt 7 from a stacker, and a guide 15 and a fixing component 14, which fix ink to the recording medium P that has been peeled off and transport the same to an ejection stacker, are disposed upstream and downstream of the transport belt 7. The inkjet recording device 1 also has a recording medium position detection component 16 thereinside. Moreover, a solvent recovery section, which includes an exhaust fan 17 and a solvent vapor adsorption material 18, is disposed inside the inkjet recording device 1. Vapor inside the device passes through this recovery section and is exhausted to outside the device.

FIG. 2 is a diagram in which only the principal portions of the inkjet recording device 1 shown in FIG. 1 are extracted, for describing the transport belt 7 and the position control component 5. The transport belt 7 is formed of a material, which has excellent dimensional stability and has durability, and is formed from a metal, a polyimide resin, a fluorine resin, another resin, or a compound material thereof. In a case in which an electrostatic charging component is utilized for retaining the recording medium P on the transport belt or peeling the same off, as described above, the transport belt 7 may have conductivity at a side thereof that contacts the rollers 6A, 6B and 6C. In such a case, it is preferable to provide a metallic layer by coating of a resin material as mentioned above on a metallic belt, adhesion of a resin sheet on a metallic belt with adhesive or the like, or vapor deposition at a rear side of a belt of the above-mentioned resin. It is further preferable if the surface of the transport belt 7 that contacts the recording medium P is smooth. In such a case, adsorptivity of the recording medium P is favorable. The transport belt 7 is stretched between the rollers 6A, 6B and 6C and at least one of the rollers 6A, 6B and 6C is coupled with a drive source. Meandering of the transport belt 7 is restricted to a certain extent by, for example, a well-known method. As a method for restricting meandering, there is a method which alters tension at two ends of the transport belt and compensates for meandering by the 6C serving as a tension roller and an axis thereof being inclined relative to axes of the other rollers 6A and 6B in accordance with output of the transport belt position detection component 8. Further, a method of crafting axial direction cross-sectional forms of the rollers 6A, 6B and 6C and the like can be favorably employed. In FIG. 2, the discharge head 2 is disposed with a direction of arrangement of nozzles of each color of the head being disposed in the width direction of the transport belt 7, the discharge head 2 is disposed on the position control component 5, and main scanning is carried out by transporting the recording medium with the transport belt 7. The position control component 5 is structured to include a motor or the like, and the position control component 5 can be moved in the direction of arrow X in FIG. 2 (the width direction of the transport belt) by instructions from a system control section 30 (see FIG. 3) in accordance with output from the transport belt position detection component 8. Because main scanning is carried out by transport of the recording medium using the transport belt 7 in this manner, imaging is possible at a higher speed than in a case of serial scanning with a head, as in other inkjet printers that are commercially available.

Figure 3:
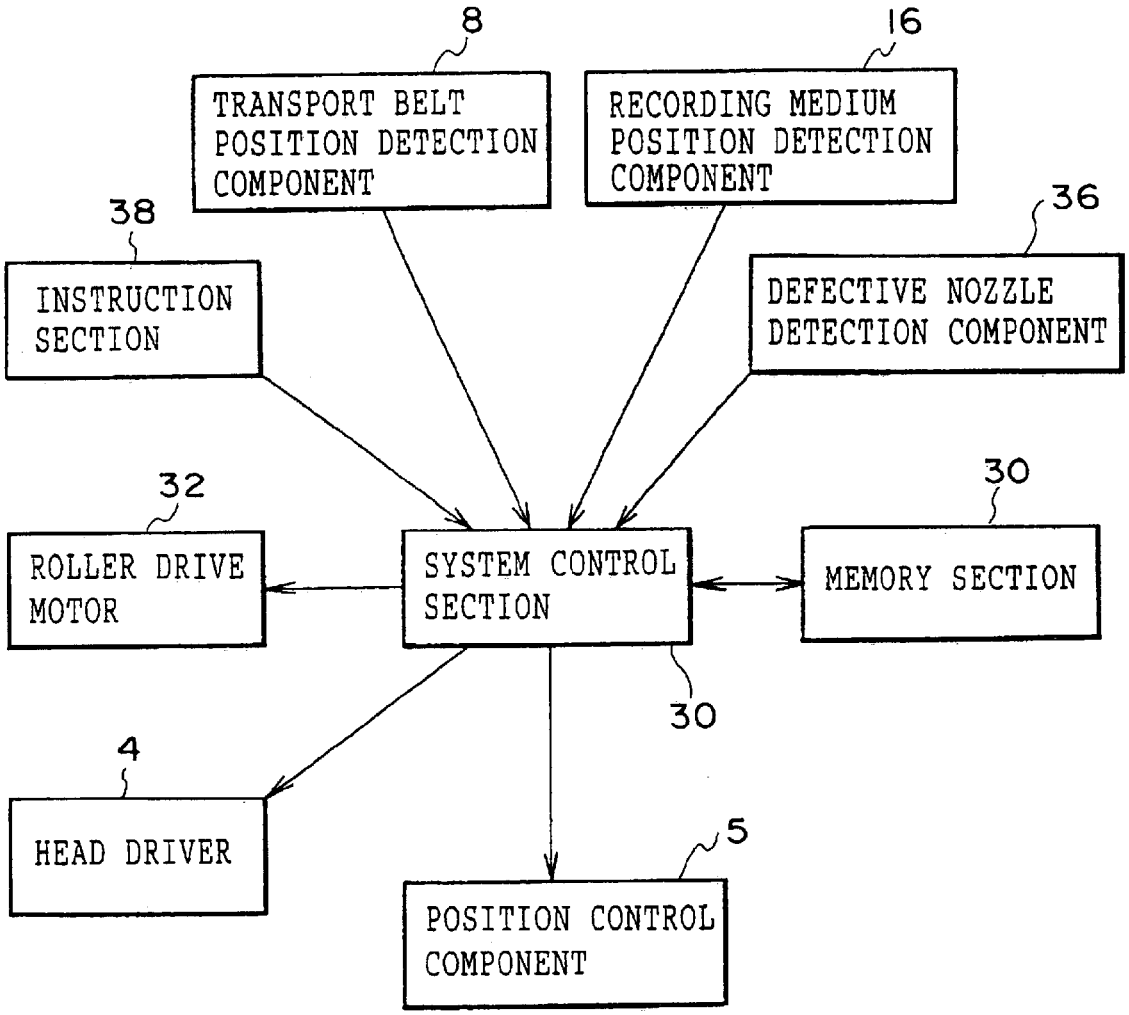
FIG. 3 is a schematic block diagram of a control system of an inkjet printing device of an embodiment of the present invention.

FIG. 3 is a diagram showing a schematic block diagram of a control system of the present embodiment. The system control section 30 is structured to include a CPU, a ROM and a RAM, and is connected with the transport belt position detection component 8, the recording medium position detection component 16, the position control component 5, the head driver 4, a roller drive motor 32, a memory section 34, a defective nozzle detection component 36 and an instruction section 38.

The transport belt position detection component 8 detects a position P1 of an end portion of the transport belt 7, and outputs the detected position P1 to the system control section 30. The recording medium position detection component 16 detects a the detected position P2 to the system control section 30. The position control component 5 is made to be movable for moving orthogonally to the transport direction on the basis of instructions from the system control section 30. The roller drive motor 32 is a motor, which supplies driving force to one or more of the rollers 6A, 6B and 6C. The head driver 4 is a section, which controls operation of each nozzle on the basis of image data. The defective nozzle detection component 36 detects defective nozzles among the nozzles of the discharge head 2, at which a discharge failure, a discharge amount abnormality, a discharge direction abnormality or the like has occurred, and continuously outputs positions of these defective nozzles to the system control section 30. The instruction section 38 is a section for implementing various instructions from a user, including instructions for starting/stopping recording processing at the inkjet recording device 1.

An ideal position P0 of the transport belt 7 is stored at the memory section 34. A relationship between a movement amount M of the discharge head 2 and a difference S between the ideal position P0 and the position of the transport belt 7 that is actually detected by the transport belt position detection component 8 (see FIG. 5) is also stored at the memory section 34. Here, the movement amount M is a movement amount in the event of a relative position of the transport belt 7 and the discharge head 2 being displaced such that a relative position relationship between the discharge head 2 and the transport belt 7 is the same as in a case in which the transport belt 7 is positioned at the ideal position P0. The movement amount M is specified in accordance with the difference S. Positions and numbers of defective nozzles that are detected by the defective nozzle detection component 36 are also stored at the memory section 34.

Figure 4:
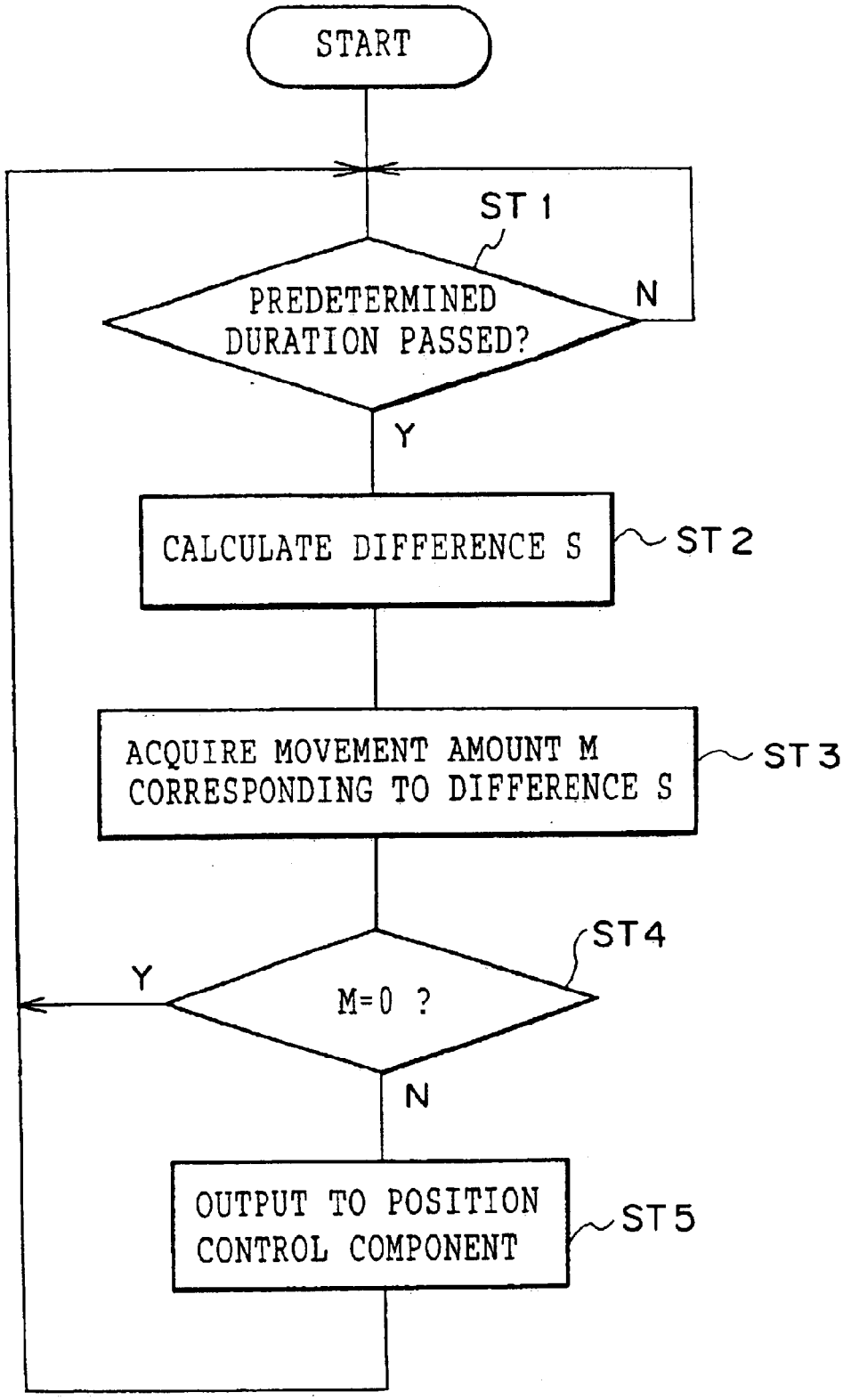
FIG. 4 is a flowchart of a discharge head movement process of the embodiment of the present invention.

Now, an image-recording method relating to the present invention will be described using FIG. 2. In a case in which a multi-channel head is utilized as the discharge head 2, the recording medium is transported in a state in which the recording medium P is retained at the transport belt 7, and image formation is implemented by sub-scanning in the transport belt width direction. At this time, a sub-scanning process of the discharge head 2 is selected in accordance with a relationship between nozzle density of the head and picture definition, and a method of interlacing. In order to carry out recording at the whole of a surface of the recording medium, rotation for a number of cycles is carried out in a state in which the transport belt 7 supports the recording medium. Consequently, meandering of the transport belt in the width direction can cause linear irregularities and a deterioration of the image. However, with the present invention, the position of the transport belt 7 in the direction orthogonal to the recording medium transport direction of the transport belt (i.e., in the transport belt width direction) is detected by the transport belt position detection component 8, and the position control component 5 drives on the basis of output from the transport belt position detection component 8. The discharge head 2 is displaced by precisely an amount of misplacement of the transport belt 7 in the width direction (herebelow, a processing sequence relating to displacement of the discharge head is referred to as "discharge head movement processing"). This discharge head movement processing will be described in detail with reference to FIG. 4.

Figure 5:
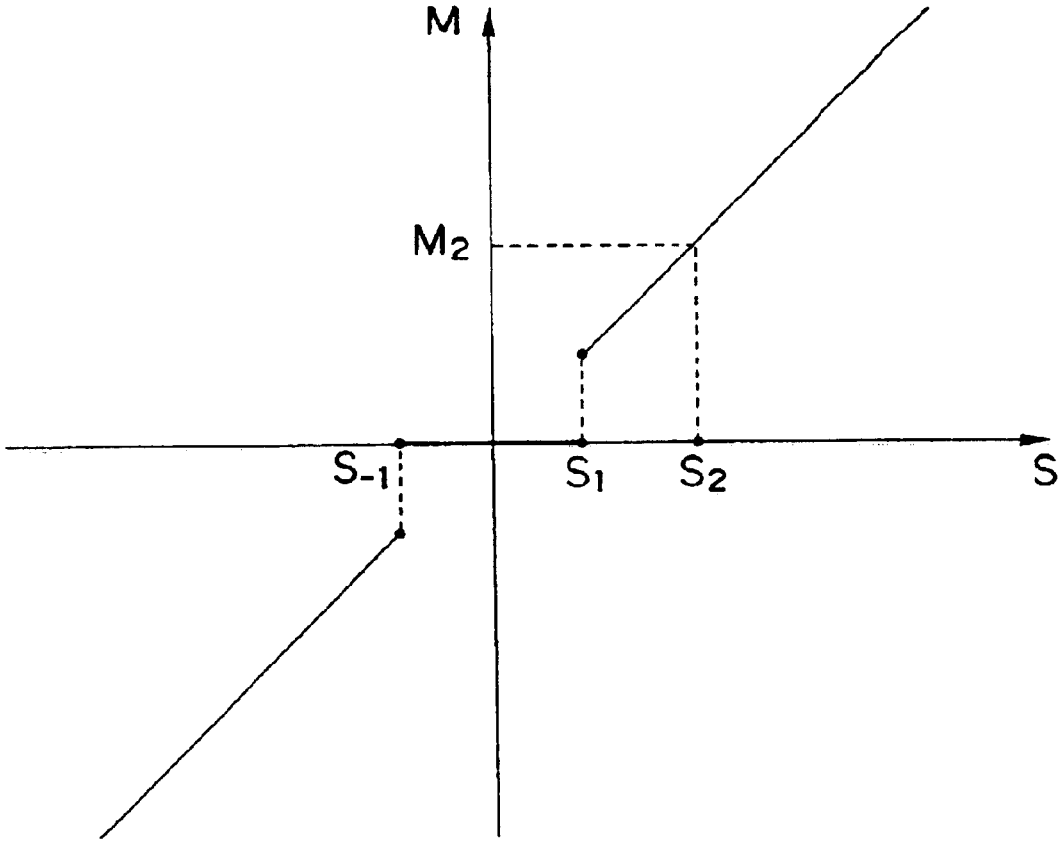
FIG. 5 shows a relationship between a difference S and a movement amount M.

When an instruction to commence recording processing at the inkjet recording device 1 is inputted from the instruction section 38, the system control section 30 commences the discharge head movement processing. This process is repeated at predetermined intervals from the commencement of recording processing. In a step ST1, the process waits for a predetermined duration to pass. When the predetermined duration has passed, in step ST2, the transport belt position P1 that is outputted from the instruction section 38 is read in, the ideal position P0 stored in the memory section 34 is read in, and the difference S between the ideal position P0 and the transport belt position is calculated. In step ST3, a movement amount M corresponding to the calculated difference S is outputted from the memory section 34. For example, as shown in FIG. 5, in a case in which the calculated difference is $S_2$, a movement amount $M_2$ is read out. In step ST4, it is judged whether or not the movement amount M is zero. If the movement amount M is zero, the process returns to step ST1, and processing is repeated therefrom. Here, as shown in FIG. 5, in cases in which the misplacement amount of the transport belt 7 is in a range $S_{-1} \leqq S \leqq S_1$, because the effect of such a misplacement on the image that is formed would be slight, the movement amount M is set to zero and displacement of the position control component 5 is not implemented. If the determination in step ST4 is negative, in step ST5, an instruction is outputted to move the position control component 5 such that the position control component 5 is displaced by precisely the movement amount M. Then the process returns to step ST1. This processing is repeated while the transport belt 7 is being driven.

When the position control component 5 receives the movement instruction from the system control section 30, the position control component 5 moves in accordance with the movement instruction. Thus, the positional relationship between the discharge head 2 and the transport belt 7 is corrected.

Note that, although position detection by the transport belt position detection component 8 in the above detects the position of the end portion of the transport belt, various position detection methods are possible, such as detecting another position such as, for example, a position at which a detection mark on the transport belt is located, and the like. Thus, meandering of the transport belt can be corrected, and a high quality image, which is free of linear irregularities, can be formed.

Now, in a case in which a full-line headwhich covers the whole of an image formation region in the sub-scanning direction is used as the discharge head 2, the recording medium P is transported in the state in which the recording medium P is retained at the transport belt 7, and the whole of an image can be implemented in just one cycle of passing the discharge head 2 (one cycle of main scanning), without sub-scanning. In such a case, nozzle density of the discharge head 2 is equal to definition of the image and, in ordinary circumstances, it is common for the discharge head to become inoperative. Consequently, in ordinary circumstances, deformation of a recorded image, such as a crooked image or the like, occurs due to meandering of the transport belt. Accordingly, in the present invention, the position of the transport belt 7 in the width direction of the transport belt is detected by the transport belt position detection component 8, and the position control component 5 drives on the basis of output from the transport belt position detection component 8. The discharge head 2 (the full-line head) is moved by precisely the amount of displacement of the transport belt 7 in the width direction. Thus, meandering of the transport belt 7 can be compensated for and a high quality image can be formed.

In the above, meandering of the transport belt 7 is corrected on the basis of the position of the transport belt 7. However, meandering of the transport belt 7 may be corrected on the basis of the position P2 of the recording medium. In such a case, image formation is carried out with the position of the recording medium P in the direction orthogonal to the transport direction being detected by the recording medium position detection component 16, and the discharge head 2 being moved in accordance with this detected position.

Next, other desirable effects provided by the present invention are described.

When a problem occurs at an arbitrary nozzle of the discharge head 2, such as an inability to discharge, a discharge amount variation, a discharge direction variation or the like, resetting of the defective nozzle is carried out at a maintenance station, as described later. However, in a case in which the defect cannot be eliminated even by resetting, replacement of the head that includes the defective nozzle is necessary. In particular, in the case of a system, which uses an inoperative full-line head, operations of the system are impossible until the head is replaced. In the present invention, in such a case, detection and specification of the defective nozzle(s) is carried out, detection of the position of the transport belt 7 in the direction orthogonal to the recording medium transport direction of the transport belt is detected by the transport belt position detection component 8, and the position control component 5 drives to move the discharge head 2 on the basis of the value outputted by the transport belt position detection component 8 and on the basis of a displacement value which enables interpolation to imaging positions of the defective nozzle(s) Specifically, at a time of passage of the discharge head for a first cycle of the transport belt 7 supporting the recording medium P, image formation is carried out by all nozzles other than defective nozzles. Then a peeling-off component is not driven, but at a time of passage of a second cycle of the discharge head, discharge head movement is carried out and image interpolation is implemented by properly working nozzles, which are nozzles other than the defective nozzles, at image formation positions of the defective nozzles (below, this sequence of processing is referred to as interpolation processing). This interpolation processing is carried out by inputting information about the defective nozzles to the system control section 30, which is structured to include the CPU, the ROM and the RAM and serves as an interpolation processing component, and issuing instructions to the head driver 4 on the basis of the image data. This interpolation processing will be described with reference to FIG. 6.

Figure 6:
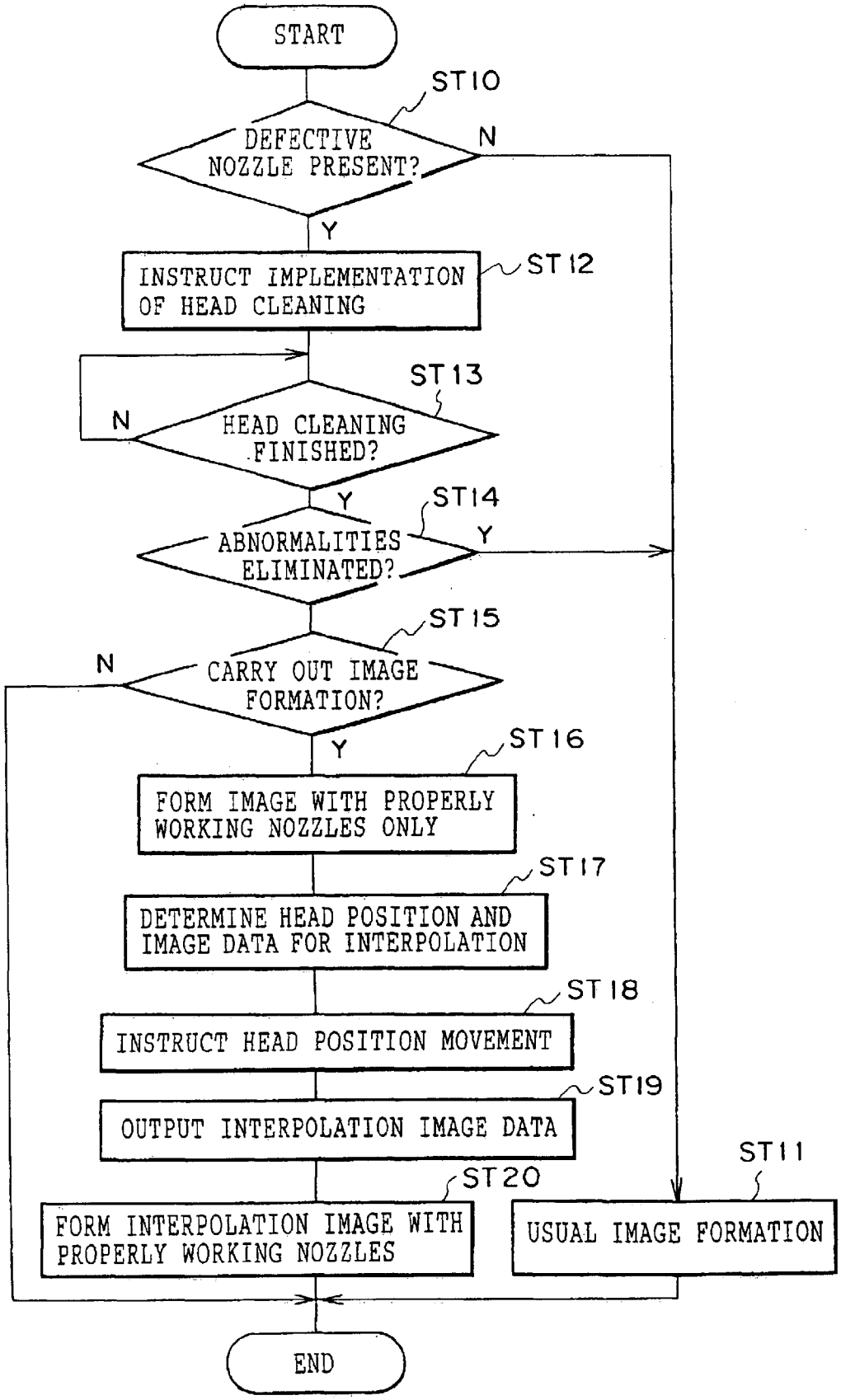
FIG. 6 is a flowchart of an interpolation process of the embodiment of the present invention.

When an instruction to commence recording processing at the inkjet recording device 1 is inputted from the instruction section 38, the interpolation processing shown in FIG. 6 commences at the system control section 30. In step ST10, it is judged whether or not there are any defective nozzles, that is, whether or not positions and numbers of defective nozzles have been stored in the memory section 34. If there are no defective nozzles, the process advances to step ST11, and usual image formation processing is carried out. If there are any defective nozzles, in step ST12, an instruction is issued to a predetermined processing section such that cleaning of the discharge head 2 is implemented. In step ST13, the process waits until the cleaning finishes. When the cleaning has finished, in step ST14, it is judged from the results of detection by the defective nozzle detection component 36 whether or not the abnormality of each defective nozzle has been eliminated. If this determination is affirmative, the process advances to step ST11, and the usual image formation processing is carried out. If the determination is negative, in step ST15, it is judged whether or not image formation is to be carried out. This determination may be carried out on the basis of positions and numbers of defective nozzles, and may be carried out on the basis of input from the instruction section 38 (an instruction from a user). If it is determined that image formation is not to be carried out, the process finishes. However, if it is judged that image formation is to be carried out, in step ST16, image formation processing is carried out with properly working discharge nozzles only. Here, image formation with the defective nozzles is prevented. In step ST17, on the basis of the positions of defective nozzles stored in the memory section 34, image data for interpolation and a position of the discharge head 2 are determined such that image formation can be carried out with properly working nozzles instead of the defective nozzles. In step ST18, the position control component 5 outputs an instruction to move to the determined position. In step ST19, the determined image data for interpolation is outputted to the head driver 4. Hence, in step ST20, interpolation image formation processing is carried out by the properly working nozzles on the basis of the determined image data, and the process finishes.

Next, an image formation process including structural elements of the system of FIG. 2 relating to the present invention will be described. A known roller may be employed for the feed roller 12, and the feed roller 12 is disposed so as to raise feeding capability with respect to the recording medium. Dirt, paper dust and the like may adhere on the recording medium P, and it is desirable to remove the same. A known non-contact method, such as suction removal, blowing removal, electrostatic removal or the like, or contact method, such as a brush, a roller or the like, can be employed for a removal component. In the present invention, it is desirable to employ either of air suction and air blowing, or a combination thereof. The feed roller may be structured by a slightly adhesive roller, may be structured with a roller cleaner, and may carry out the elimination of dirt, paper dust and the like when feeding the recording medium. The recording medium P supplied by the feed roller passes the guide 13, and is transported to the transport belt 7.

An example of a transport belt in which a metal belt is coated with a fluorine resin has been described for the transport belt. However, the present invention is not limited thus, and various transport belts as mentioned above can be employed. A metal layer rear face of the transport belt 7 is connected to ground via the roller 6A. The recording medium that is being transported is subjected to electrostatic adsorption to the transport belt by the electrostatic adsorption component 9. This electrostatic adsorption is implemented by a scorotron electrostatic charger connected to a negative side of a high-voltage source, which is shown in FIG. 1. Besides a scorotron, various methods may be employed for the electrostatic adsorption component, such as a corotron, a solid body charger, a discharge needle or the like. Further, as described below, conductive rollers can also be favorably employed.

Because of the electrostatic adsorption component 9, the recording medium P is electrostatically adsorbed to the transport belt 7 and does not lift up, and the recording medium is uniformly charged. Here, the static adsorption component is used as a charging component for the recording medium, but can be provided separately. A transport speed of the transport belt when the recording medium is being charged is within a range in which charging can be reliably implemented, and may be the same as a transport speed during image formation or may be different therefrom. The electrostatic adsorption component may operate for a plurality of cycles of rotation, and uniform charging may be carried out.

Electrostatic inkjet image formation is implemented by transporting the charged recording medium P to the discharge head section with the transport belt 7, biasing the recording medium P to a charging potential, and superposing the same with recording signal voltages. A heating component is provided at the transport belt, which is effective for raising the temperature of the recording medium and improving image quality, because rapid fixing of discharged ink droplets on the recording medium is promoted, and ink-smearing is further suppressed.

The recording medium P on which the image has been formed has charge removed therefrom by the electrostatic elimination component 10, is peeled off from the transport belt 7 by the mechanical component 11, and is transported to a fixing section. An example with a corotron static eliminator is shown as the charge elimination component in FIG. 1. However, various methods, such as a scorotron, a solid body charger, a discharge needle and the like can be applied, or a conductive roller as described later can be favorably applied. As a mechanical component, known techniques such as a separating blade, a counter-rotating roller, an air knife and the like are applicable.

The recording medium P that has been peeled off is fed to the image fixing component 14, and fixing is implemented. As a fixing component, known components for thermal fixing, fusion fixing, flash exposure fixing and the like can be employed singly or in combination. For thermal fixing, illumination from an infrared rays or halogen lamp or illumination from a xenon flash lamp, hot wind fixing utilizing a heater, and heat roller fixing are common. In a case in which coated paper or laminated paper is used as the recording medium, water content in the paper will be rapidly vaporized by a sudden rise in temperature, and phenomena such as the occurrence of irregularities at the paper surface, known as blistering, will occur. Therefore, in view of preventing blistering, it is preferable to provide a plurality of fixing devices and to vary electric power and/or separation of the fixing devices from the recording medium so as to raise the temperature of the paper gradually. For fusion fixing, a solvent, which has affinity with a resin component in the ink, is ejected or exposed as vapor, and excess solvent vapor is recovered. Flash fixing using a xenon lamp or the like is effective for carrying out fixing in a short time.

It is desirable to keep anything from coming into contact with the image on the recording medium, at least in steps from image formation with the oil-based ink by the discharge head 2 until fixing by the image fixing component 14. A movement speed of the recording medium at a time of fixing can be freely selected, may be the same as the transport speed of the transport belt 7 during image formation, and may be different therefrom. In the case of these speeds being different, it is favorable to provide a speed buffer for the recording medium P just before the image fixing component 14. The recording medium P that has been fixed is ejected past the guide 15 to the ejection stacker.

The present inkjet recording device has a recovery component for recovering solvent vapor emitted from the oil-based ink. The recovery component is formed with the solvent vapor adsorption material 18. Any of various active carbons can be favorably employed as the solvent vapor adsorption material. Air, which includes solvent vapor from inside the device, is guided to the adsorption material by the exhaust fan 17, the vapor is adsorbed and recovered, and the air is exhausted to outside the device.

The present invention is not limited to the examples described above. Numbers, forms, relative positions, polarities and the like of structural devices such as rollers, chargers and the like can be freely selected. Furthermore, a system for four-color printing has been described, but systems with more numerous colors, combining hypochromic inks, specialist inks and the like are also possible.

Now, an image formation step will be described in more detail. The inkjet recording device 1 shown in FIG. 1 includes the system control section 30 shown in FIG. 3. The system control section 30 receives image data from an external device such as a computer, RIP, image scanner, magnetic disc device, image data transmission device or the like. The system control section 30 performs color separation, and divides the color-separated data into appropriate numbers of pixels and gradations. The system control section 30 carries out screening processing and calculation of shading dot proportional areas, and allocates the data to each head driver 4.

The system control section 30 performs control of timings of movements of the discharge head 2 and the position control component 5 and of discharges of the oil-based ink in accordance with transport timings of the transport belt 7. Control of the discharge timings is carried out using output from the recording medium position detection component 16, and/or output signals from the transport belt 7 and/or an encoder or photo interpreter disposed at a transport belt drive component.

The inkjet recording device 1 may include a discharge head withdrawal component, in which case the system control section carries out control for separation between the discharge head 2 and the recording medium P which is retained on the transport belt 7. This is implemented by mechanical distance control such as abutting rollers, or control of the position of the head or the transport belt by signals from an optical separation detector. Thus, during image formation, the discharge head 2 and the recording medium P are kept at a predetermined separation and high quality image formation is possible. Further, the separation component operates so as to separate the discharge head 2 to at least 500 $\mu$m from the transport belt 7 at times other than times of image formation. Thus, by withdrawing the discharge head at non-imaging times, the discharge head is protected from physical damage and/or soiling, and a longer lifetime can be achieved.

The inkjet recording device 1 may include maintenance components such as a cleaning component and the like as necessary. For example, in a case in which a rest state continues for a long time, or in a case in which problems have arisen with image quality, components for brushing a distal end of the discharge head 2 with a brush, a cloth or the like, circulating only the ink solvent, supplying only the ink solvent, applying suction to the discharge section while circulating ink, or the like may be applied singly or in combination for maintaining excellent imaging conditions. Further, for preventing adherence of the ink, it is effective to include a component, which covers and enters the discharge head 2 when the discharge head 2 has been filled with ink solvent vapor. In a case in which soiling is very bad, it is effective to forcibly suck ink from the discharge section, insert jets of air, ink or ink solvent through ink channels, and/or apply voltage or ultrasound in a state in which the head is submerged in the ink solvent, and the like. These methods can be employed singly or in combination.

Figure 7:
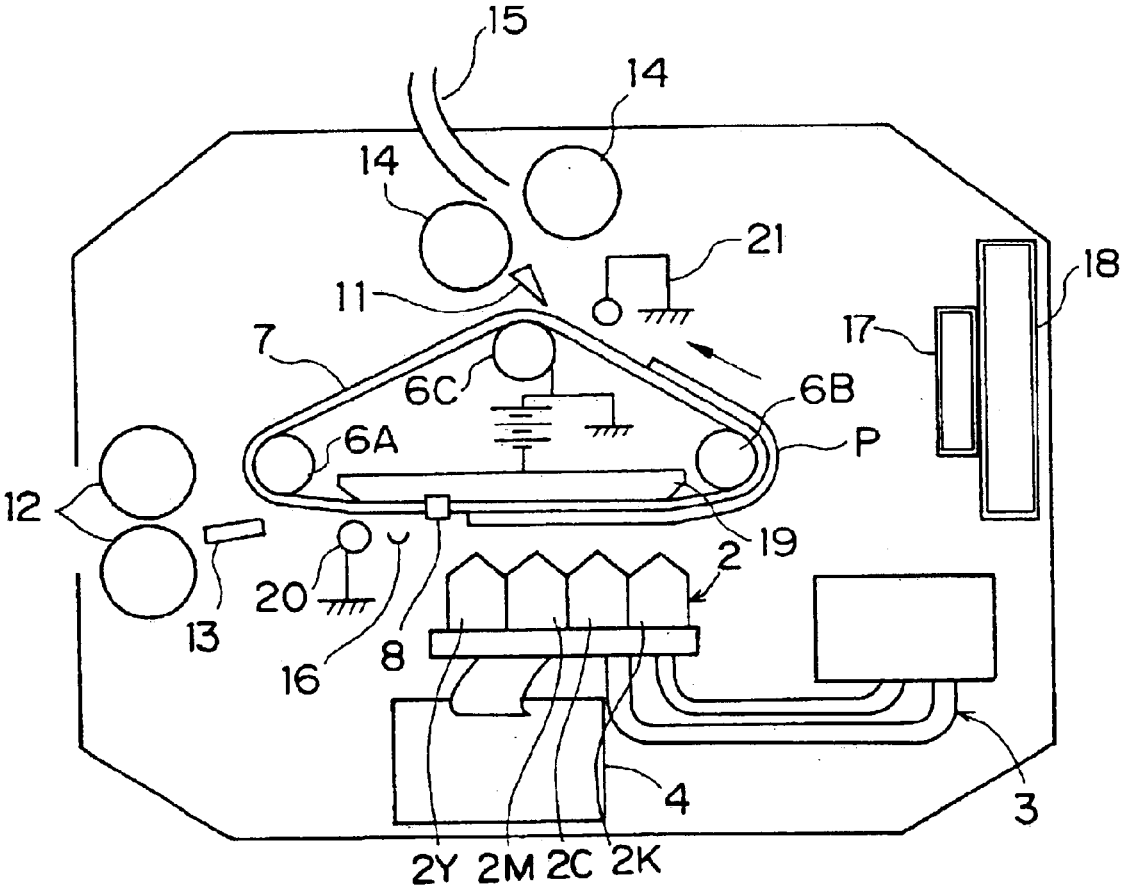
FIG. 7 is a structural diagram schematically showing another example of an ink-discharging imaging device, which utilizes the present invention.

FIG. 7 is a structural example of another inkjet recording device relating to the present invention. This device differs from the example of FIG. 1 in that a conductive platen 19 is disposed at the rear face of the transport belt 7, and conductive rollers 20 and 21 are disposed to serve as static adsorption and separation components. The conductive platen 19 is disposed such that the transport belt 7 protrudes further toward the discharge head side than in a case of being stretched by the rollers 6A and 6B. Hence, looseness of the transport belt 7 in the vertical direction is suppressed, and separation between the discharge head 2 and the recording medium P is made constant. Hence, high quality image formation is possible. Accordingly, a tension member may be provided at a position at the rear face of the transport belt 7 opposing the discharge head 2. Rather than the platen, wires, rollers and the like can be employed. Such structures are also applicable to the devices of FIG. 1 and FIG. 8 (described later).

Retention and separation steps of the recording medium in the device of FIG. 7 will be described. The recording medium P transported by the feed roller 12 and the guide 13 is nipped between the conductive roller 20, which is connected to ground, and the conductive platen 19, which is biased. The recording medium P is electrostatically adsorbed by an electric field between the conductive roller 20 and the conductive platen 19. The adsorptive recording medium P is subjected to image formation by the discharge head 2, which acts as an electrode opposing the biased conductive platen 19. Then the charge is eliminated by the roller 6C and the conductive roller 21, and the recording medium P is lifted up by the mechanical component 11 and peeled off from the transport belt. Here, the front face of the conductive platen 19 may be covered with an insulative layer, which can effectively suppress discharges therefrom during image formation by the discharge head 2. Other structural elements, and operations, effects and the like thereof, are simply derived from the descriptions of the inkjet recording device of FIG. 1. Accordingly, further explanations thereof are omitted. Naturally, the present invention is not limited to the examples described above, and numbers, forms, relative positions, electrical polarities and the like of structural devices such as rollers, platens, discharge heads and the like may be freely selected. Moreover, conductive rollers may be biased. Further still, a system for four-color printing has been described, but systems with more numerous colors, combining hypochromic inks, specialist inks and the like are also possible.

Figure 8:
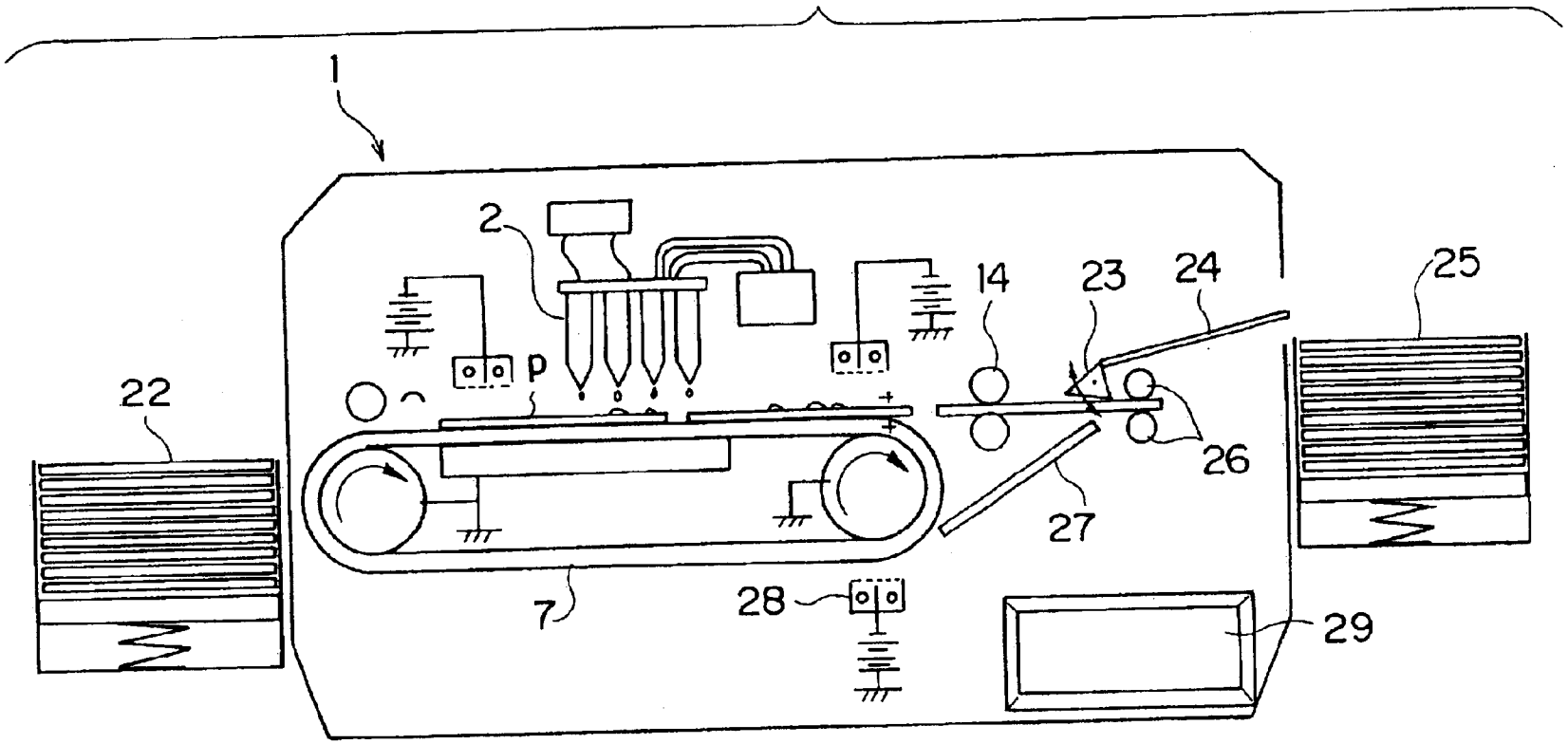
FIG. 8 is a structural diagram schematically showing yet another example of an ink-discharging imaging device, which is capable of two-sided printing, which utilizes the present invention.

FIG. 8 is yet another structural example of an inkjet recording device relating to the present invention. This device has an automatic recording medium inversion apparatus. FIG. 8 is an explanatory view of an inkjet recording device capable of double-sided printing. The discharge head 2 uses a full-line head, and the transport belt 7 is a device, which is capable of supporting a plurality of recording mediums. Thus, even higher speed printing is possible with this device. To perform single-sided printing, a recording medium P which has been supplied from a supply stacker 22 and has had an image formed thereon passes through the image fixing component 14, is passed along an ejection guide 24 by a recording medium path-switching component 23, and is ejected to an ejection stacker 25. Alternatively, when double-sided printing is to be carried out, after the recording medium P has passed the image fixing component 14, the recording medium is passed along a recording medium reversal roller 26 and a guide for double-sided printing 27 by the recording medium path-switching component 23. In the same manner as described above, the recording medium is again adsorbed to the transport belt by a static adsorption component 28. At this time, the printed image surface is a surface that contacts the transport belt. Printing is implemented at the reverse side in the same way as at the already printed side. The recording medium P is passed through the image fixing component 14 again, passed along the ejection guide 24 by the recording medium path-switching component 23, and ejected to the ejection stacker 25. Here, the recording medium P has been described as a sheet form. However, a roll-form recording medium may be cut into sheets. In such a case, a cutter component is provided in the device and the recording medium P is transported after having been cut to a freely selected size. The inkjet recording device 1 is further equipped with a cooling-contraction recovery device 29. The cooling-contraction recovery device 29 can effectively eliminate large amounts of fused vapor that are generated during printing at high speed. The recovered solvent can be re-used. Other structural elements, and operations, effects and the like thereof, simply accord with the descriptions of the inkjet recording device of FIG. 1. Accordingly, further explanations thereof are omitted. Further, the present invention is not limited to the examples described above, and numbers, forms, relative positions, electrical polarities and the like of structural devices such as rollers, platens, discharge heads and the like may be freely selected. Moreover, conductive rollers may be biased. Further still, a system for four-color printing has been described, but systems with more numerous colors, combining hypochromic inks, specialist inks and the like are also possible. In addition, bookmaking functions may be favorably applied to the printed recording mediums.

Next, an image-forming device will be described in detail in relation to ink discharge.

An inkjet recording device employed for the present inkjet printing method is formed with the discharge head 2 and an ink circulation system. The ink circulation system further includes an ink tank, an ink circulation apparatus, an ink density control apparatus, and an ink temperature management apparatus. A stirring apparatus may be included in the ink tank. The stirring apparatus suppresses coagulation and precipitation of solid components of the ink. A rotating vane, an ultrasound oscillator or a circulating pump may be employed as the stirring apparatus. These can be employed singly or in combination. The ink temperature management apparatus is disposed to enable stable formation of high quality images without ink characteristics and dot diameters changing due to ambient temperature changes. A heating element, such as a heater, a Peltier element or the like at the ink tank, the head or an ink channel, and/or a cooling element is provided to serve as the ink temperature control apparatus. Known methods can be employed for control and the like using a temperature sensor, for example, a thermostat or the like. In a case in which the temperature control apparatus is disposed in the ink tank, the stirring apparatus is provided so as to make the temperature distribution therein constant. It is desirable that the temperature is not less than 15° C. and not more than 60° C., more desirably not less than 20° C. and not more than 50° C. The stirring apparatus may be dually used for keeping the temperature distribution constant and for the purpose of suppressing coagulation and precipitation of solid components of the ink. In the present printing device, in order to carry out high quality image formation, the ink density control apparatus is included. The ink density is physically measured by optical detection, electrical measurement, viscosity measurement or the like, or management and the like of the ink density is carried out after a number of images have been formed. Liquid supply from a supplementary concentrated ink tank and/or an ink carrier tank for dilution to the ink tank is controlled in accordance with output signals from one or a combination of an optical detector, a conduction measurement instrument and a viscosity measurement instrument provided in the ink tank and/or ink channel in a case in which management is carried out using physical measurements, or in accordance with a number of printed images and/or a frequency of printing in a case in which management is carried out after a number of images have been formed.

Next, the discharge head will be described.

A single-channel head, a multi-channel head or a full-line head may be employed as the discharge head 2. The discharge head 2 carries out main scanning in accordance with rotation of the transport belt 7. In a case of a multi-channel head or full-line head having a plurality of discharge portions, an arrangement direction of nozzles is set to substantially the width direction of the transport belt 7. In the case of a single-channel head or multi-channel head, the discharge head 2 is moved continuously or stepwise in the width direction of the transport belt by the aforementioned system control section. The discharge head 2 discharges the oil-based ink at the recording medium P, which is adsorbed to the transport belt 7, at discharge positions and shading dot proportional areas obtained by calculations at the system control section. Hence, the shading dot images form an image with the oil-based ink on the recording medium P in accordance with light and shade of a printing original. This operation continues until an oil-based ink image is formed on the recording medium P. In a case in which the discharge head 2 is a full-line head having a length substantially the same as the width of the recording medium, it is possible to form the oil-based ink image on the recording medium P and provide printed matter with one cycle of the transport belt. When main scanning is carried out by rotation of the transport belt 7 in this manner, high-speed printing can be carried out, and a high precision image can be formed with operation of the position control component 5.

Next, the discharge head will be described using FIGS. 9 to 13. The scope of the present invention is in no way limited by the following examples.

An inkjet head that can be favorably employed for the present invention relates to an inkjet method for applying electrophoresis to charged particles within an ink channel and increasing ink density in a vicinity of an opening to implement discharge, and is often a head which implements discharge of ink droplets by electrostatic attractive forces generated at an opposing electrode which is disposed at a recording medium or a rear face of a recording medium. Accordingly, when the recording medium or the opposing electrode is not facing the head, or the recording medium or opposing electrode is at a position facing the head but voltage is not applied, discharge of an ink droplet will not occur even if voltage is inadvertently applied to a discharge electrode, the head experiences vibrations or the like, and the interior of the device will not be soiled.

Figure 9:
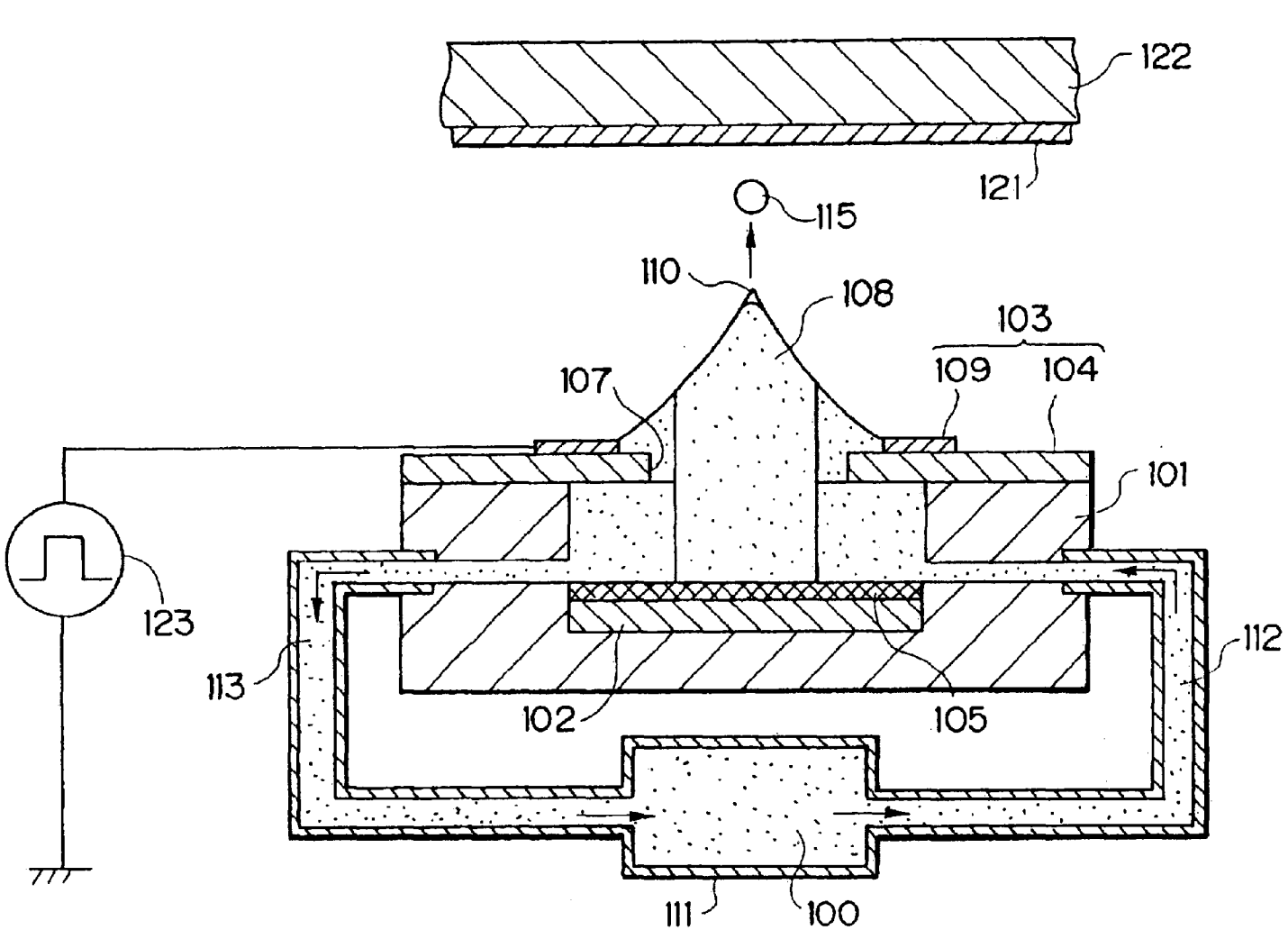
FIG. 9 is a schematic structural diagram showing a principal portion of an inkjet recording device, which utilizes the present invention.
Figure 10:
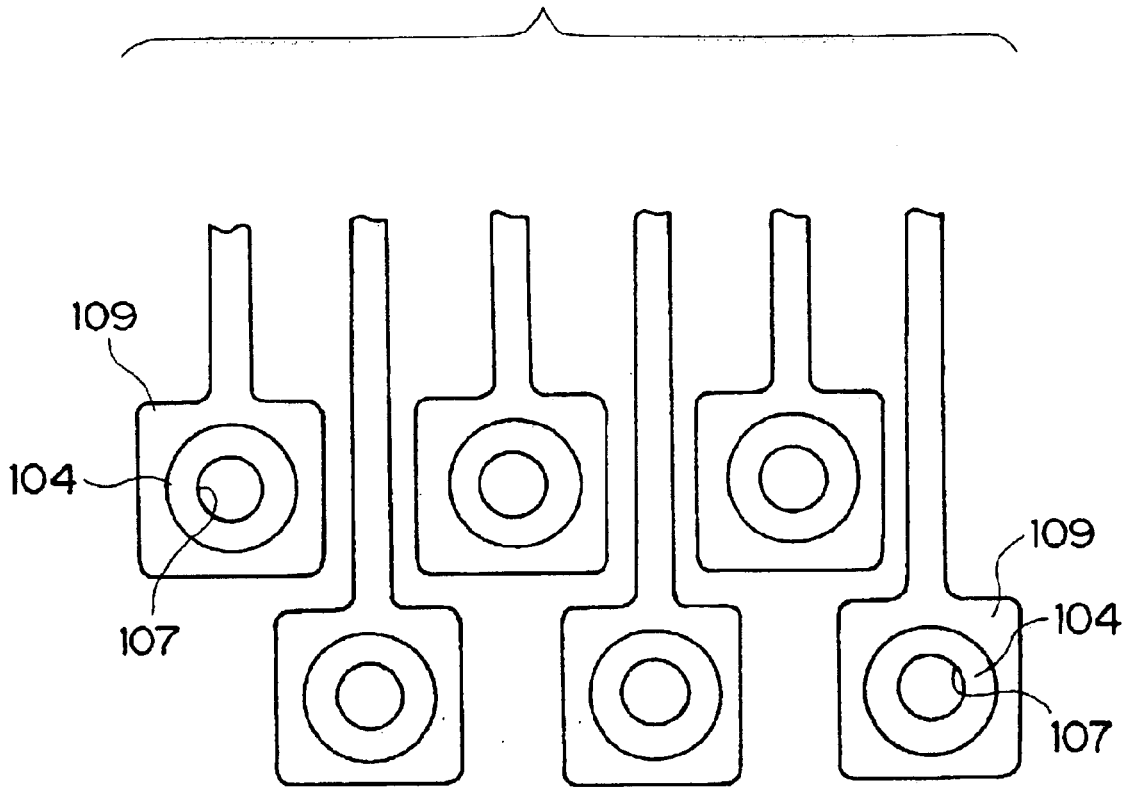
FIG. 10 is a diagram, viewed from a recording medium side, of a portion of the principal portion shown in FIG. 9.

FIGS. 9 and 10 are schematic diagrams for describing a favorable example of a discharge head. FIG. 9 illustrates structure of a multi-channel inkjet head relating to the present invention, and shows a cross section of a discharge electrode corresponding to a recording head. In FIG. 9, oil-based ink 100 passes from a circulation apparatus 111, which includes a pump, through an ink supply channel 112 which is connected to a head block 101, and is supplied between a head baseplate 102 and a discharge electrode baseplate 103. The oil-based ink 100 passes through a recovery channel 113, which is similarly connected to the head block 101, and is recovered at the circulation apparatus 111. The discharge electrode baseplate 103 is structured with an insulative baseplate 104, which includes a through-hole 107, and a discharge electrode 109, which is formed at a recording medium side of surroundings of the through-hole 107. On the head baseplate 102, a protruding ink guide 108 is disposed at a substantially central position of the through-hole 107. The protruding ink guide 108 is formed by an insulative member of plastic resin, a ceramic or the like. The protruding ink guide 108 is retained on the head baseplate 102 by a predetermined method, and the protruding ink guides 108 are disposed at a row separation and pitch so as to be substantially concentric with the through-holes 107. The protruding ink guide 108 is a flat plate of a certain thickness, whose distal end is formed to be cut away in a triangular shape or a trapezoidal shape. A distal end portion of the protruding ink guide 108 serves as an ink droplet launch point 110. A slit-form groove may be formed from the distal end portion of the protruding ink guide 108, and such a slit may be smoothly supplied with ink to the ink droplet launch point 110 by the capillary effect. Hence, a recording frequency can be improved. Arbitrary surfaces of the ink guide may have conductivity in accordance with requirements. In such a case, by setting conductive portions of the ink guide to an electrically floating state, an electric field can be efficiently formed at the ink launch point by application of a small voltage. Each protruding ink guide 108 protrudes from the corresponding through-hole by precisely a predetermined vertical distance substantially in an ink droplet launch direction. A recording medium is disposed on a transport belt 122, which faces the distal end of the protruding ink guide 108. A space is formed between the head baseplate 102 and the discharge electrode baseplate 103, and an electrophoresis electrode 105 is formed at a base portion of this space. By applying a predetermined voltage to the electrophoresis electrode 105, colored charged particles in the ink can be forced in the direction of a discharge position of the ink guide by electrophoresis of the particles, and discharge responsiveness can be improved.

Next, a specific structural example of the discharge electrode baseplate 103 will be described using FIG. 10. FIG. 10 is a diagram of the discharge electrode baseplates 103 viewed from a recording medium side thereof. A plurality of discharge electrodes are arranged in an array pattern of two rows. The through-holes 107 are formed at the center of each discharge electrode, and the respective discharge electrodes 109 are separately formed at surroundings of the through-holes 107. In the present embodiment, the inner diameter of the discharge electrode 109 is slightly larger than the diameter of the through-hole 107. However, these diameters may be the same as one another. The insulative baseplate 104 is formed of polyimide with a thickness of around 25 to 200 $\mu$m, the discharge electrode 109 is formed of copper foil with a thickness of around 10 to 100 $\mu$m, and the through-hole 107 is formed with an internal diameter of around 100 to 250 $\mu$m. An insulating layer may be provided at the surface of the discharge electrode.

Herein, explanation is given for an example of a case in which ink, which includes positively charged colored particles, is used. However, an ink in which colored particles are negatively charged may be employed.

Next, recording operations of an inkjet recording device according to the present embodiment will be described. Here, the descriptions are given for an example of a case in which ink including positively charged colored particles is used.

At the time of recording, the oil-based ink 100 is supplied through the ink supply channel 112 from the circulation apparatus 111 as shown in FIG. 9, and the oil-based ink 100 is supplied to the ink droplet launch point 110 at the distal end of the protruding ink guide 108. A portion of the oil-based ink 100 passes through the recovery channel 113 and is recovered at the circulation apparatus 111. Here, pulse voltages of, for example, +500 V at an "ON" time are applied from a signal voltage source 123 to the discharge electrode 109 as signal voltages in accordance with image signals. At this time, a voltage of +300 V is applied to the electrophoresis electrode 105. Correspondingly, the recording medium is charged to −1.7 kV by a corona charging component. Depending on circumstances, a conductive platen, as in the device shown in FIG. 7, may be charged to, for example, −1.7 kV as a bias voltage. When the discharge electrode 109 is put into the ON state (the state in which 500 V is applied thereto), an ink droplet 115 flies off from the ink droplet launch point 110 at the distal end of the protruding ink guide 108. The ink droplet 115 flies toward the recording medium and forms an image. In order to precisely control flight of the ink droplets after launch and improve impact precision on the recording medium, it is very common to provide structures such as intermediate electrodes between the discharge electrode and the recording medium, guard electrodes for suppression of electric field interference between the discharge electrodes, and the like. Naturally, such structures can be favorably employed as necessary in the present embodiment. By disposing a porous material between the head baseplate 102 and the discharge electrode baseplate 103, effects of variations in internal pressure of the ink due to movement of the head and the like can be prevented, and an increase in speed of ink supply to the through-hole 107 after discharge of an ink droplet can be achieved. Thus, flights of the ink droplets 115 can be made consistent, and a favorable image with consistent densities can be quickly formed on the recording medium. FIGS. 9 and 10 have been described for an example in which the nozzles are arranged in a staggered pattern of two rows. However, the present invention is not limited thus. The nozzles may be arranged in a greater number of rows, and a plurality of head blocks may be combined to form a discharge head.

In the above description, an example in which the colored particles are positively charged has been described. However, the colored particles may be negatively charged. In such a case, the electrode polarities mentioned above are all reversed.

Further, in the above description, a case has been described in which the discharge electrode has the same polarity as the colored particles and the recording medium has the opposite polarity to the colored particles. However, the present invention is not limited to the above, as long as polarities of the discharge electrode and the recording medium generate an electric field that will move the colored particles in a direction toward the recording medium. That is, the discharge electrode may be set to the same polarity as the colored particles and the recording medium set to the same polarity as the colored particles, or the recording medium may be not charged.

Further, the discharge electrode may be set to the opposite polarity to the colored particles, with the recording medium being set to the same polarity as the colored particles. Further again, the discharge electrode maybe set to 0 V with the recording medium being set to the opposite polarity to the colored particles.

Of the cases mentioned above, in cases in which the recording medium is charged to the same polarity as the colored particles and cases in which the recording medium is not charged, charge of the opposite polarity to the colored particles is not present on the recording medium, and thus the colored particles will be not be attracted to positions of the recording medium at which image formation is not required, and smearing can be avoided. Furthermore, in cases in which the discharge electrode is negatively charged, a voltage application driver for negative charges may be employed as a head driver. In comparison to positive charge voltage application drivers, there are a greater number of types of negative charge voltage application drivers manufactured for general use, and costs are lower. Accordingly, a range of head driver options is greater and a reduction in costs can be expected.

Figure 11:
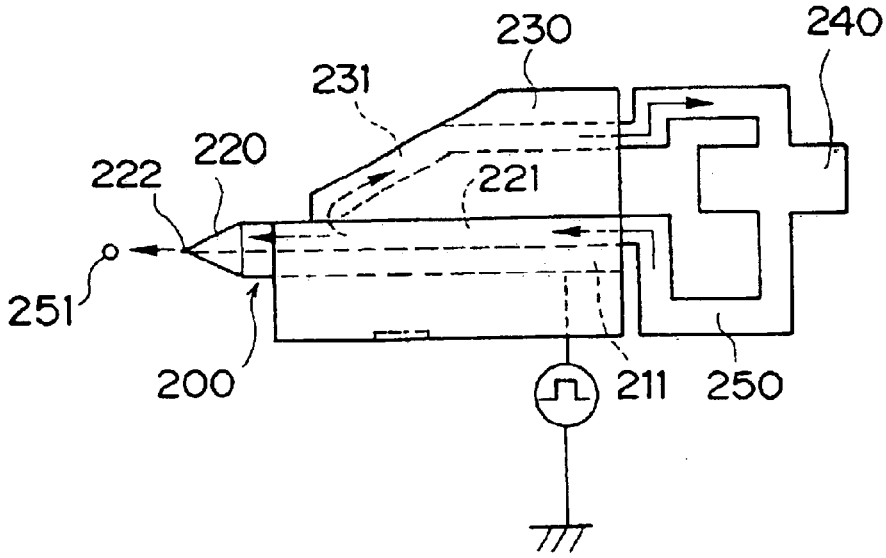
FIG. 11 is a schematic structural diagram showing a principal portion of another inkjet recording device, which utilizes the present invention.
Figure 12:
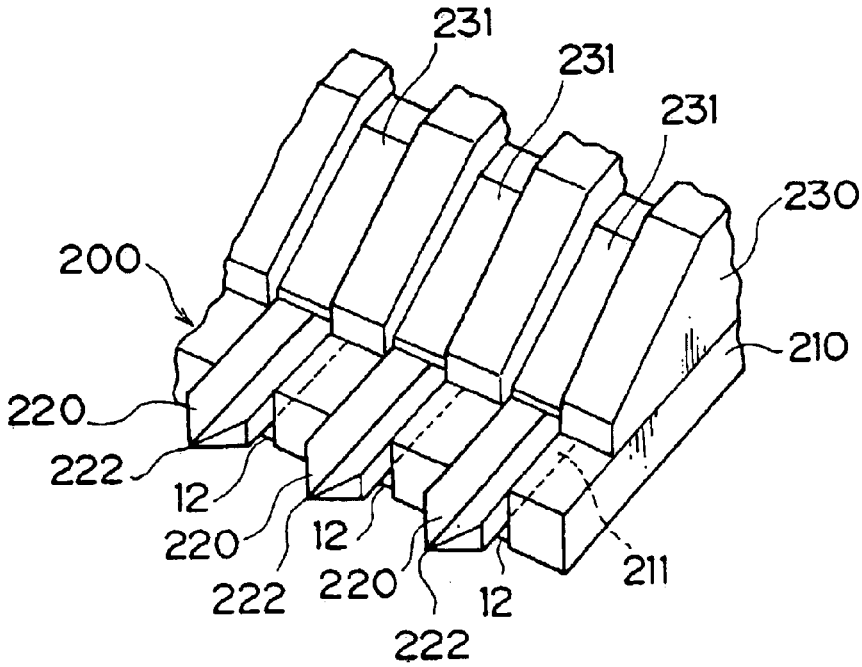
FIG. 12 is a perspective view of a portion of the principal portion shown in FIG. 11.
Figure 13:
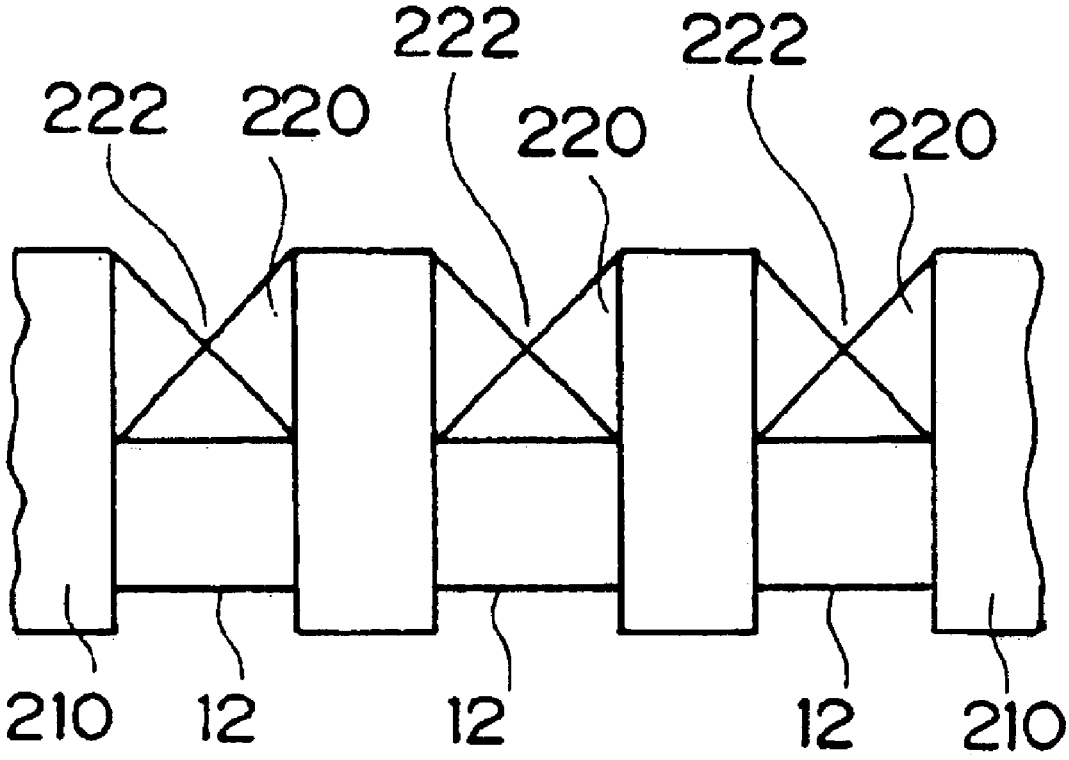
FIG. 13 is a view of the principal portion shown in FIG. 11, viewed from a nozzle distal end portion side thereof.

FIGS. 11 to 13 are schematic diagrams describing another example of a discharge head relating to the present invention. FIG. 11 illustrates structure of a discharge head relating to another embodiment of the present invention. In FIG. 11, the discharge head is structured by a head baseplate 200 and an ink recovery baseplate 230. The head baseplate 200 is equipped with a discrete nozzle 220. The discrete nozzles 220 are arranged in an array on an insulating baseplate 210. The ink recovery baseplate 230 is disposed on the head baseplate 200. A resin, which is excellent in processability, such as PEEK (poly ether ether ketone) or the like, or a ceramic whose surface is coated with insulation, may be utilized at the insulating baseplate 210. A groove 211 for retaining the discrete nozzle 220 is formed in the upper face of the insulating baseplate 210.

The discrete nozzle 220 is formed of a metallic material. As shown in FIG. 12, the discrete nozzle 220 has a V-shaped groove in a longitudinal direction thereof and a distal end of the discrete nozzle 220 has a tapered form. Specifically, as shown in FIG. 13, the distal end has a four-sided pyramid shape from which one side is missing, and the V-shaped groove is formed as far down as a substantially central position of the discrete nozzle 220. Alternatively, an insulating material may be machined to the same shape and a conductive layer formed at inner walls of the V-shaped groove by plating or vapor deposition or the like. In the structure shown in FIGS. 11 to 13, the distal end of the discrete nozzle 220 is formed with a sharp shape. However, the distal end of the discrete nozzle may be formed to be slightly rounded.

The ink recovery baseplate 230 is structured of the same material as the insulating baseplate 210, and a groove corresponding with the discrete nozzle 220 is formed at an inclined portion of the ink recovery baseplate 230. This groove is an ink recovery channel 231. This groove for ink recovery has a rectangular-shaped cross-section. However, the form thereof is not limited as long as it features concavity. The recording head is connected with an ink circulation apparatus 240, which includes a pump and an ink channel, and an oil-based ink 250 is suitably flowed. A transport belt, which retains a recording medium at a surface thereof, is disposed frontward of the recording head.

Next, operation of the discharge head relating to the present embodiment will be described. The oil-based ink 250 supplied by the ink circulation apparatus 240 passes through an ink supply channel (the V-shaped groove) 221, and reaches the distal end of the head. Because the ink supply channel 221 is formed by a V-shaped groove, surface tension acts on the oil-based ink 250 at a groove bottom portion in accordance with the capillary effect. Thus, the oil-based ink 250 is reliably supplied to a distal end point 222 of the discrete nozzle, which is an ink launch point. When the amount of ink supplied reaches as far as the depth of the V-shaped groove, an excess of the oil-based ink 250 passes along the groove formed in the ink recovery baseplate 230, and flows into the ink recovery channel 231. Because strong surface tension is affected in accordance with the capillary effect in the groove of the ink recovery baseplate 230, similarly to the insulating baseplate 210 at the head baseplate 200, the ink can be reliably recovered. Thus, because excess ink is constantly circulated, an ink amount at the distal end of the discrete nozzle 220 can be constantly kept to a suitable amount. When the inkjet recording device begins recording operation, pulse voltages of, for example, 500 volts at ON times are applied to the discrete nozzle 220 from a signal voltage source 271, to serve as signal voltages in accordance with image signals. Accordingly, ink droplets 251 fly off from the distal end ink droplet launch position 222 of the nozzle 220, fly toward the recording medium and form image dots.

Continuing, another example of a discharge head that can be applied to the inkjet recording device 1 of the present invention will be described.

Figure 14:
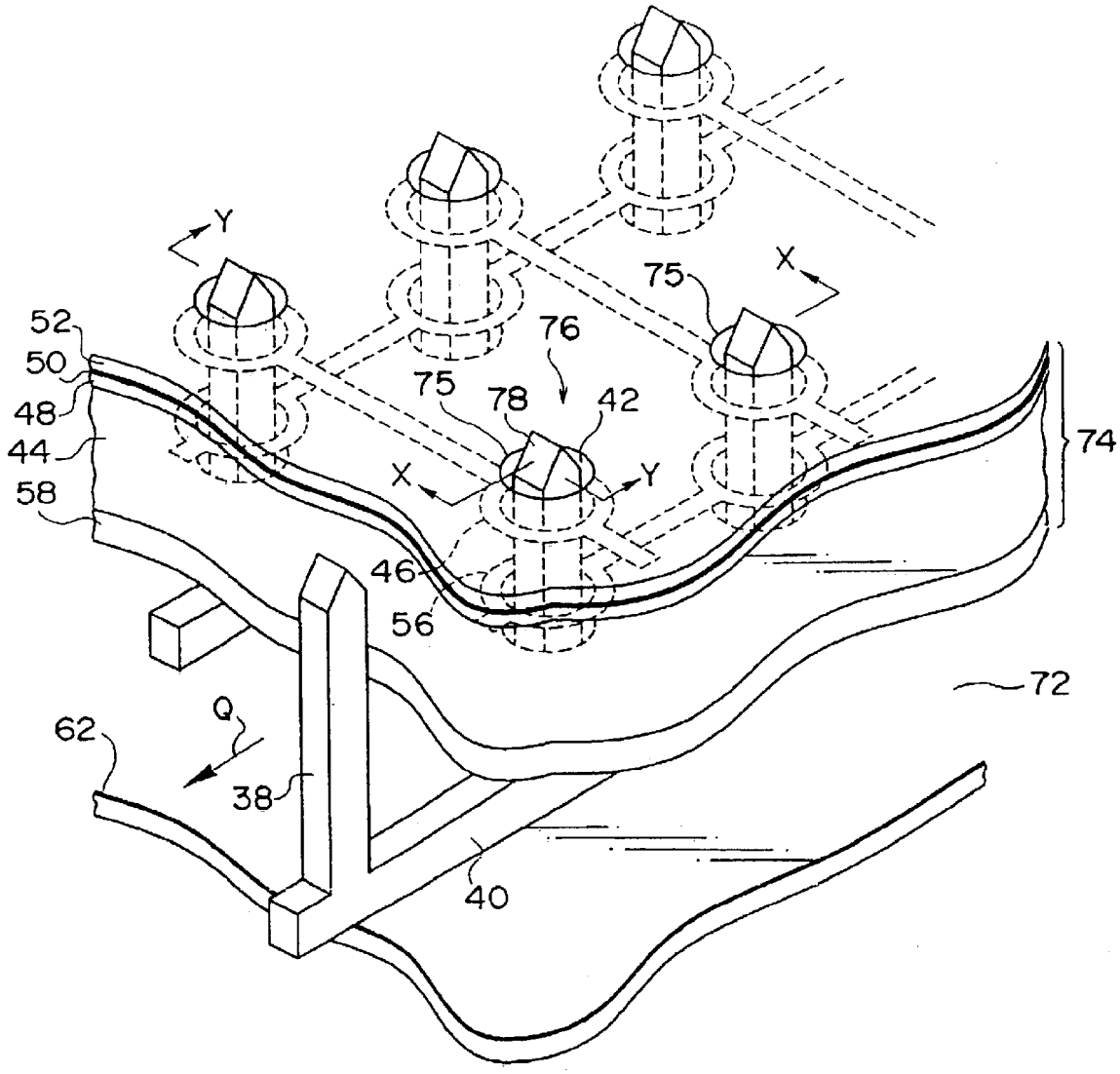
FIG. 14 is a perspective view showing structure of an inkjet head of yet another inkjet recording device of the present invention.
Figure 15:
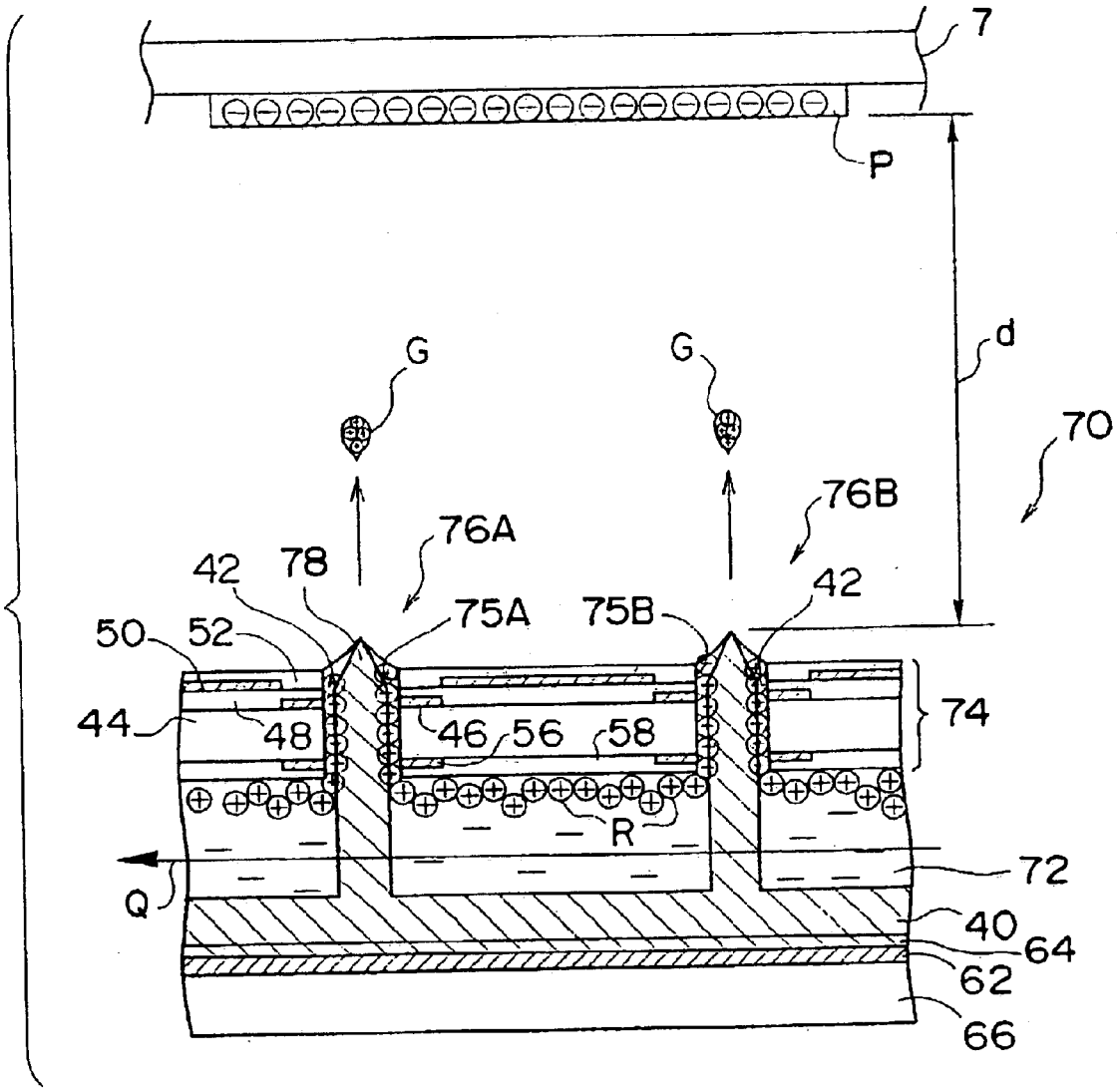
FIG. 15 is a side sectional view (cut along the line X—X in FIG. 14) showing a state of distribution of charged particles when a number of discharge portions that are employed in the inkjet head shown in FIG. 14 is large.

As shown in FIGS. 14 and 15, an inkjet head 70 includes an ink channel 72, an electrically insulative baseplate 74 and a plurality of discharge portions 76. An ink flow Q in one direction is formed in the ink channel 72. The baseplate 74 structures an upper wall of the ink channel 72. The discharge portions 76 discharge ink toward the recording medium P. At each discharge portion 76, an ink guide portion 78 is provided, which guides ink droplets G, which fly from the ink channel 72, toward the recording medium. At the baseplate 74, openings 75 are formed, through which the respective ink guide portions 78 are inserted. An ink meniscus 42 is formed between each ink guide portion 78 and an inner wall face of the opening 75. A gap d between the ink guide portion 78 and the recording medium P will often be around 200 to 1000 $\mu$m. At a lower end side of the ink guide portion 78, the ink guide portion 78 is fixed to a support shaft portion 40. In FIG. 14, for ease of understanding, edges of a guard electrode at the respective discharge portions are omitted.

The baseplate 74 includes an insulating layer 44, first discharge electrodes 46, an insulating layer 48, a guide electrode 50 and an insulating layer 52. The insulating layer 44 separates and insulates the discharge electrodes with a predetermined separation. The first discharge electrodes 46 are formed at an upper side of the insulating layer 44. The insulating layer 48 covers the first discharge electrodes 46. The guide electrode 50 is formed at an upper side of the insulating layer 48, and the insulating layer 52 covers the guide electrode 50. The baseplate 74 also includes second discharge electrodes 56 and an insulating layer 58. The second discharge electrodes 56 are formed at a lower side of the insulating layer 44, and the insulating layer 58 covers the second discharge electrodes 56. The guide electrode 50 is provided to prevent electric fields due to voltages applied to the first discharge electrodes 46 and/or second discharge electrodes 56 and the like from causing effects at neighboring discharge portions.

A floating conduction plate 62 is provided in an electrically floating state at the inkjet head 70. The floating conduction plate 62 structures a bottom face of the ink channel 72. The floating conduction plate 62 causes positively charged ink particles (charged particles) R in the ink channel 72 to migrate upward (that is, toward the recording medium side) with induced voltages which are steadily generated by pulse-form discharge voltages applied to the first discharge electrodes 46 and the second discharge electrodes 56. An insulating film 64, which is electrically insulative, is formed at a front face of the floating conduction plate 62. The insulating film 64 prevents destabilization of characteristics and components of the ink due to introduction of charge into the ink and the like. Electrical resistivity of the insulating film 64 is desirably at least $10^{12}$ $\Omega\cdot$cm, and more desirably at least $10^{13}$ $\Omega\cdot$cm. It is desirable that the insulating film 64 is not corrosible with respect to the ink, so that corrosion of the floating conduction plate 62 by the ink can be prevented. Furthermore, the floating conduction plate 62 is covered from below by an insulating member 66. With this structure, the floating conduction plate 62 can be set to a completely electrically insulated state.

At least one of the floating conduction plate 62 is provided at each head unit (for example, in the case of four heads, C, M, Y and K, the number of free floating conduction plates is at least one for each head, and common floating conduction plates between the C and M head units and the like are not provided).

For the ink at the ink channel 72, an ink in which charged particles of colorant with particle diameters of around 0.1 to 5.0 μm are dispersed in a carrier liquid may be used. The carrier liquid is required to be a conductive liquid having a high electrical resistivity (at least $10^{10}$ Ω·cm). If a carrier liquid with a low electrical resistivity were to be employed, the carrier liquid itself might be subjected to the introduction of charge and become charged when voltage is applied by the discharge electrodes. As a result, density of the charged particles (the electrostatically charged ink particles) would not rise, and concentration would not occur. Furthermore, there is a concern that a low electrical inductance carrier liquid could cause electrical conduction between neighboring recording electrodes, which would be unsuitable for the present embodiment.

Comparative inductance of the inductive liquid is preferably not more than 5, more preferably 4 or less, and even more preferably 3.5 or less. With a comparative inductance in such a range, electric fields act effectively on the charged particles in the inductive liquid, and electrophoresis is easily implemented.

The inductive liquid used for the present invention is preferably a fatty carbohydrate with a straight chain form or a branched form, an alicyclic carbohydrate or an aromatic carbohydrate, or a halogen-substituted form of these carbohydrates. For example, hexane, heptane, octane, isooctane, decane, isodecane, decalin, nonane, dodecane, isododecane, cyclohexane, cyclooctane, cyclodecane, benzene, toluene, xylene, mesitylene, ISOPAR C, ISOPAR E, ISOPAR G, ISOPAR H, ISOPAR L, (ISOPAR being a trade name of Exxon Mobil Corporation), SHELLSOL 70, SHELLSOL 71 (SHELLSOL being a trade name of the Shell Corporation), AMSCO OMS, AMSCO 460 solvent (AMSCO being a trade name of American Mineral Spirits Co.), silicone oil (for example, KF-96L, manufactured by Shin-Etsu Chemical Co.) and the like may be used singly or in combination.

The colored particles that are dispersed in the non-aqueous solution may be dispersible particles of a colorant material itself that are dispersed in the inductive fluid, and may be included in dispersible resin particles in order to improve fixability. In the latter case, a method in which a pigment or the like is made into resin-covered particles by being covered with a resin material of the dispersible resin particles is common, and a method in which a dye or the like colors dispersible resin particles to make colored particles is usual. Any of pigments and dyes that are conventionally used in inkjet compositions, printing ink compositions and electrophotographic liquid developers may be used as a colorant. These colored particles are preferably included in a range of 0.5 to 30% by weight with respect to total mass of the ink, more preferably 1.5 to 25% by weight, and even more preferably 3 to 20% by weight.

In the inductive solution of the present invention, an average particle diameter of the dispersed colored particles is preferably in a range from 0.1 to 5 μm, more preferably 0.2 to 1.5 μm, and even more preferably 0.4 to 1.0 μm. This diameter may be found using a CAPA-500 (trade name of Horiba, Ltd.).

The ink composition preferably has a viscosity in a range from 0.5 to 5 mpa·s, more preferably 0.6 to 3.0 mPa·s, and even more preferably 0.7 to 2.0 mPa·s. The colored particles have charge, and various charge control agents which are used in liquid developers for electrophotography may be employed as necessary. The charge amount is desirably in a range from 5 to 200 μC/g, more preferably 10 to 150 μC/g, and even more preferably 15 to 100 μC/g. Electrical resistance of the inductive solution may be changed by addition of a charge control agent, and a distribution ratio thereof, which is defined below, is at least 50%, more preferably at least 60% and even more preferably at least 70%.

$$P=100\times(\sigma1-\sigma2)/\sigma1$$

Here, σ1 is electrical conductivity of the ink composition, and σ2 is electrical conductivity of a supernatant of the ink composition when the ink composition is centrifuged. The electrical conductivity is a value which is found by employing an LCR meter (AG-4311, manufactured by Ando Electric Co., Ltd.) with electrodes for use with liquids (type LP-05, manufactured by Kawaguchi Electric Works Co., Ltd.), and carrying out measurement with an applied voltage of 5 V and a frequency of 1 kHz. A small-scale, high-speed, refrigerated centrifuge (SRX-201, manufactured by Tomy Seiko Ltd.) is used as a centrifuge, and dispersion is carried out for 30 minutes at a rotation speed of 14,500 rpm and a temperature of 23° C.

When an ink composition as described above is used, the charged particles are more susceptible to electrophoresis and concentration.

The electrical conductivity σ1 of the ink composition is preferably in a range from 100 to 3000 pS/cm, more preferably 150 to 2500 pS/cm and even more preferably 200 to 2000 pS/cm. When the electrical conductivity is in the above-described ranges, voltages applied to discharge electrodes need not be made extremely high, and there is no need for concern about the occurrence of electrical conduction between adjacent recording electrodes. Further, surface tension of the ink composition is preferably in a range from 15 to 50 mN/m, more preferably in a range from 15.5 to 45 mN/m, and even more preferably in a range from 16 to 40 mN/m. When the surface tension is in such a range, voltages applied to the discharge electrodes need not be made extremely high, and ink will not spread around the head to cause soiling.

Figure 16:
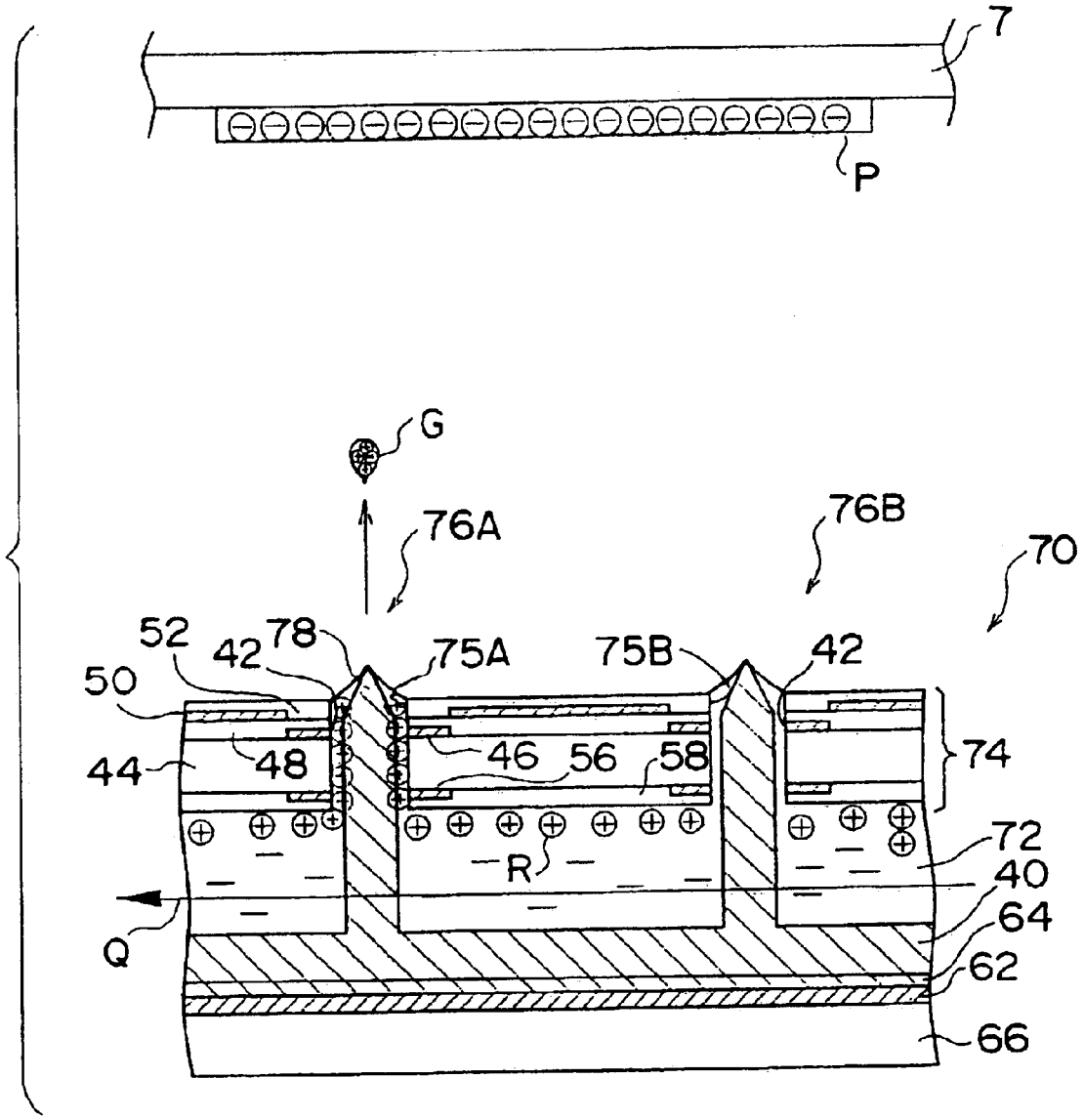
FIG. 16 is a side sectional view (cut along the line X—X in FIG. 14) showing a state of distribution of charged particles when the number of inkjet head discharge portions that are employed in the inkjet head shown in FIG. 14 is small.

As shown in FIGS. 15 and 16, when ink is to be flown from the inkjet head 70 to record at the recording medium P, a predetermined voltage (for example, +100 V) is applied to the guide electrode 50 in a state in which the ink flow Q is generated by circulating the ink in the ink channel 72.

In addition, positive voltages are applied at the first discharge electrode 46, the second discharge electrode 56 and the recording medium P such that an electric field for flying is formed between the recording medium P and the first and second discharge electrodes 46 and 56. The flying electric field attracts positively charged particles R in ink droplets G, which are guided at the ink guide portion 78 and flown from the opening 75, to the recording medium P. (In a case in which the gap d is 500 μm, it is estimated that a potential difference formed thereacross may be of the order of 1 kV to 3 kV.)

In this state, pulse voltages are applied to the first discharge electrodes 46 and the second discharge electrodes 56 in accordance with image signals, and ink droplets G, in which the density of charged particles is raised, are discharged from the openings 75. (For example, in a case in which an initial density of charged particles is from 3 to 15%, the density of charged particles in the ink droplets G is 30% or more.)

At this time, the values of voltages applied to the first discharge electrodes 46 and the second discharge electrodes 56 are adjusted in advance such that the ink droplets G are discharged only when pulse voltages are applied to both the first discharge electrode 46 and the second discharge electrode 56. Consequently, matrix driving is possible and a number of drivers can be reduced. Specifically, the voltages are set such that, in a state in which discharge is not to occur, the attractive electric field toward the recording medium is held to a range of not more than $1.5\times10^7$ V/m, more preferably not more than $1.0\times10^7$ V/m, and in a state in which discharge is to be carried out, the attractive electric field toward the recording medium is in a range of at least $2.0\times10^7$ V/m, more preferably at least $2.5\times10^7$ V/m. For example, in a case in which a separation between the first discharge electrode 46 and the second discharge electrode 56 is 50 $\mu$m, a pulse voltage of +600 V may be applied to both the first discharge electrode 46 and the second discharge electrode 56. It will be common for pulse widths to be of the order of tens to hundreds of microseconds. Diameters of dots recorded at the recording medium P can be adjusted by adjusting sizes of the pulse voltages, durations of the applied voltages, and the like.

When a pulse-form positive voltage is applied thus, an ink droplet G is guided at the ink guide portion 78 and flown from the opening 75, and adheres to the recording medium P. Also, a positive inductive voltage is generated at the floating conduction plate 62 by the positive voltages applied to the first discharge electrode 46 and second discharge electrode 56. Even if the voltages applied to the first discharge electrode 46 and second discharge electrode 56 have pulse forms, this induced voltage is substantially a steady voltage. (For example, in a case in which a pulse form voltage which repeatedly alternates between 600 V and 0 V is applied to a discharge electrode, a steady positive voltage of about 300 V is generated at the floating conduction plate 62.) Consequently, the charged particles which are positively charged within the ink channel 72 experience an upward moving force because of the electric field formed between the recording medium P and the floating conduction plate 62 and guide electrode 50, and a density of the charged particles in the vicinity of the baseplate 74 is raised. At this time, at the ink in the opening 75, the charged particles at an upper portion of the ink (the distal end portion of the ink guide) are held down by surface tension of the ink. Thus, by selecting voltage application conditions, ink properties and other conditions, a static electric attractive force from the recording medium, which acts on the charged particles in the opening 75, can be controlled. In consequence, the density of the charged particles R can be raised further.

At a time when the number of discharge portions (that is, channels from which the ink droplets are discharged) that are being deployed is large, as shown in FIG. 15, a number of charged particles that are required for the discharges is large, and numbers of the first discharge electrodes 46 and the second discharge electrodes 56 that are employed are large. Accordingly, the induced voltage, which is induced at the floating conduction plate 62, is higher, and the number of charged particles R that move toward the recording medium side also increases.

At a time when the number of discharge portions that are being deployed is small, as shown in FIG. 16, the numbers of the first discharge electrodes 46 and the second discharge electrodes 56 that are being employed are small. Accordingly, the induced voltage, which is induced at the floating conduction plate 62, is smaller. Thus, the number of charged particles R that move toward the recording medium side is comparatively small, and the number of charged particles required for the discharges is smaller. Therefore, the ink density at an upper portion of the ink is a lower density. As a result, even when the number of discharge portions being employed is smaller, clogging of an opening 75B of a discharge portion 76B (a channel not discharging ink droplets) at an ink downstream side can be avoided, and the density of an ink droplet G which flies from a vicinity of an opening 75A of a discharge portion 76A which is being employed can be favorably raised.

Figure 17:
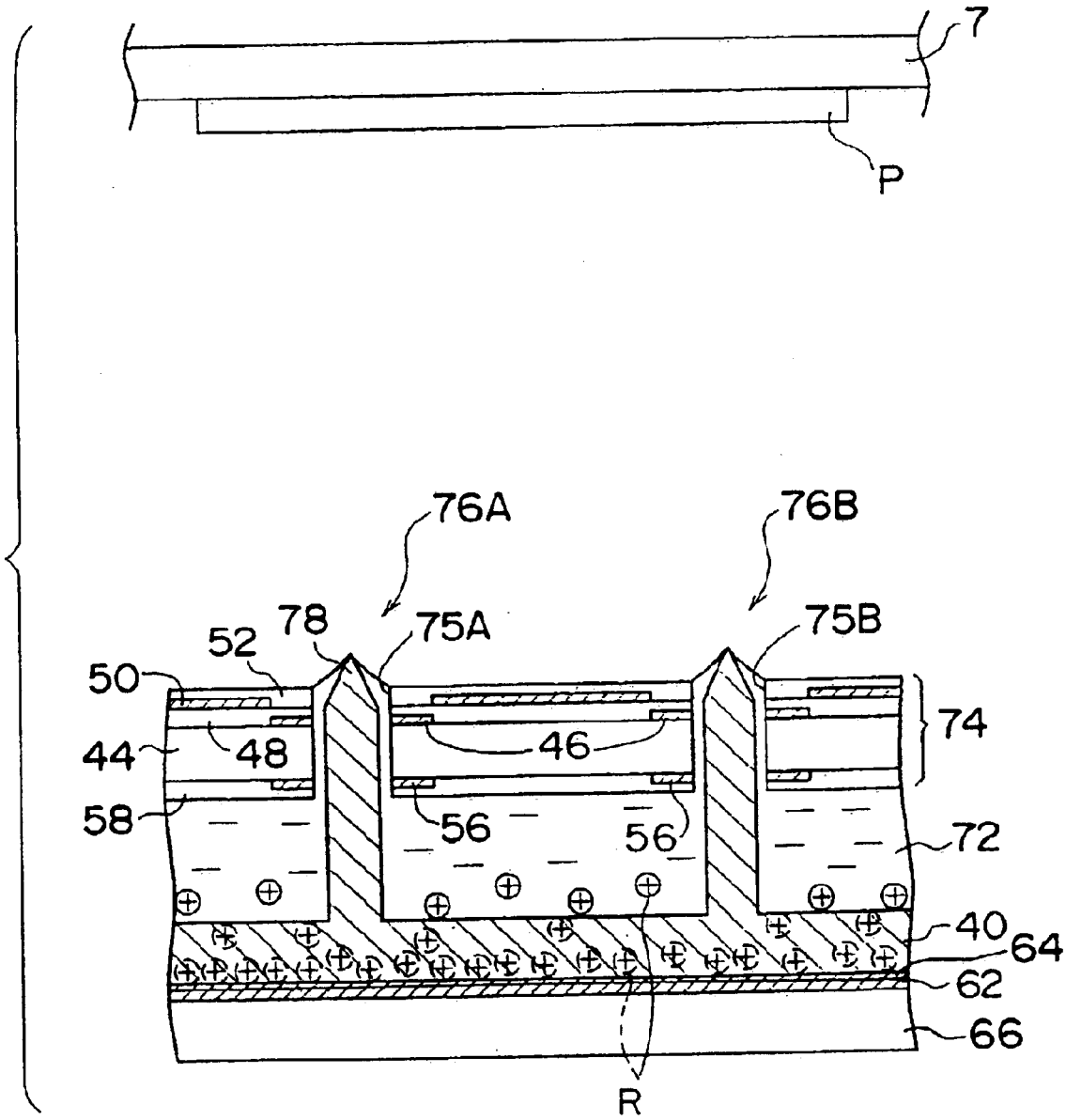
FIG. 17 is a side sectional view (cut along the line X—X in FIG. 14) showing a state of distribution of charged particles when usage of the inkjet recording device with the inkjet head shown in FIG. 14 is stopped.

When driving of the inkjet recording device 1 stops, negative charging of the recording medium P by the electrostatic adsorption component 9 is not carried out, and a certain positive voltage is applied to at least one of the first discharge electrodes 46 and the second discharge electrodes 56. Consequently, as shown in FIG. 17, the charged particles are moved toward the floating conduction plate 62 by an electric field generated between the discharge electrodes and the floating conduction plate 62, and the density of the charged particles in the ink channel at vicinities of the baseplate 74 becomes lower. Thus, the openings 75 are self-cleaning openings. A switch capable of switching between an insulating state and a state in which a negative voltage is applied for self-cleaning may be connected to the floating conduction plate 62. Thus, the floating conduction plate 62 may be set to the electrically insulated state during driving of the image-recording device, and a negative voltage may be applied to the floating conduction plate 62 when driving of the image-recording device has stopped.

As described above, in the inkjet head 70, the floating conduction plate 62 is set to an electrically floating state, which is to say, an electrically insulated state. Accordingly, the densities of charged particles in the vicinities of the baseplate 74 are higher when the number of discharge portions being deployed (that is, the number of discharge electrodes being deployed) is large, and is lower when the number of discharge portions being deployed is small. Thus, the density is automatically adjusted. As a result, even when the number of discharge portions being employed is small, clogging of openings of discharge portions at an ink downstream side can be avoided.

Furthermore, static electric force does not act on the ink as a whole, but static electric force does act on the charged particles (the charged ink particles) R, which are solid components dispersed in a carrier fluid. Thus, it is possible to record images at various recording media such as usual paper, non-absorbent PET films and the like, and images can be formed with high image quality on various recording media, without smearing on the recording medium, the occurrence of flowing or the like.

Figure 18:
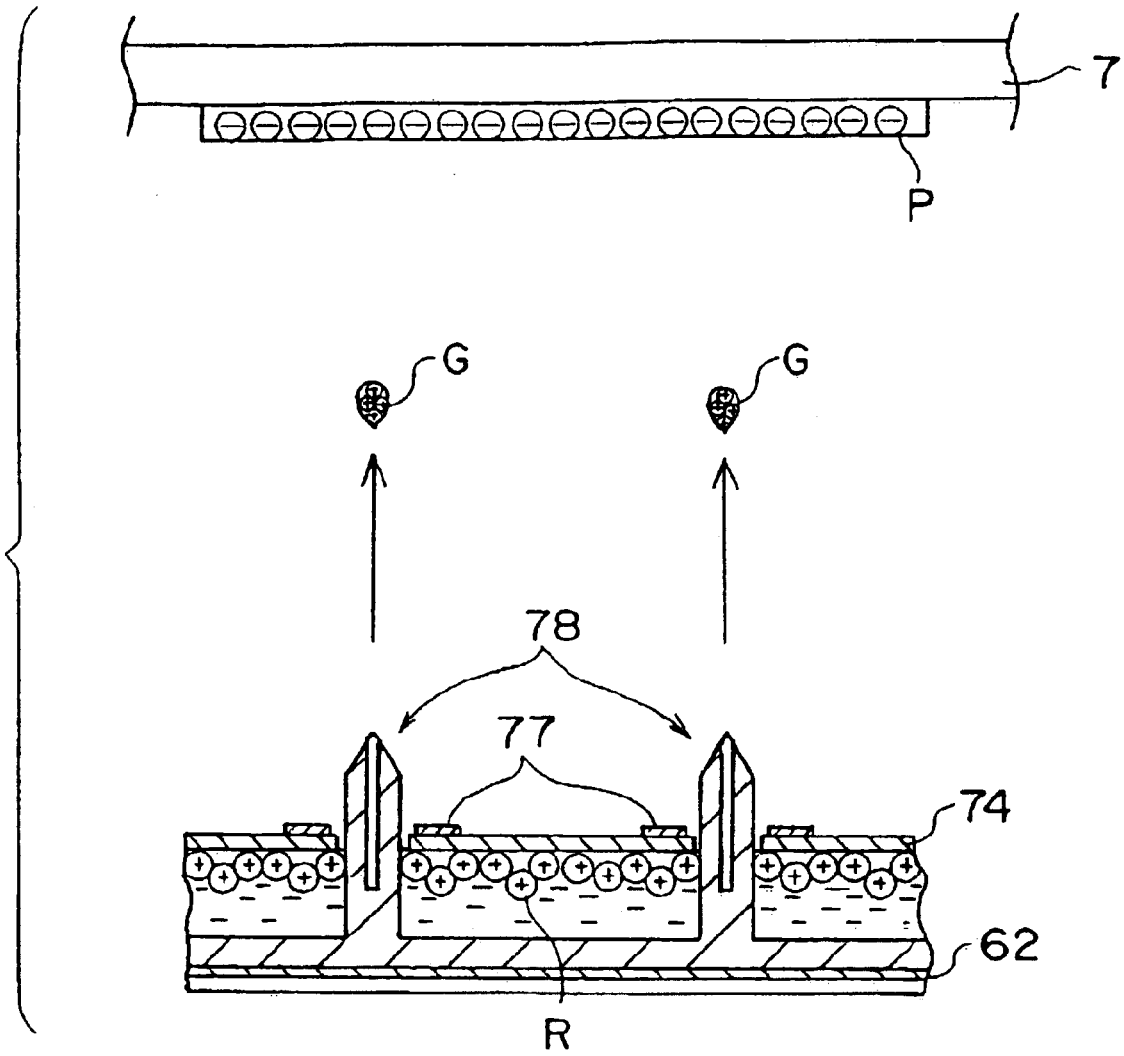
FIG. 18 is a side sectional view showing a variant example of an inkjet head, which applies the present invention.

The present embodiment is an example in which two of the discharge electrodes are provided at each discharge portion (that is, an example in which the discharge electrodes are provided in two layers). However, it is also possible to prevent clogging of the opening 75 in the same manner when only one discharge electrode is provided at each discharge portion. Further, as shown in FIG. 18, the ink guide portion 78 may be provided with a discharge electrode 77 at an upper side of the electrically insulative baseplate 74 such that, when a predetermined positive voltage is applied to the discharge electrode 77, an electric field for flying an ink droplet toward the recording medium P is formed and ink at which the ink meniscus is raised forms the droplet and is launched.

Figure 19:
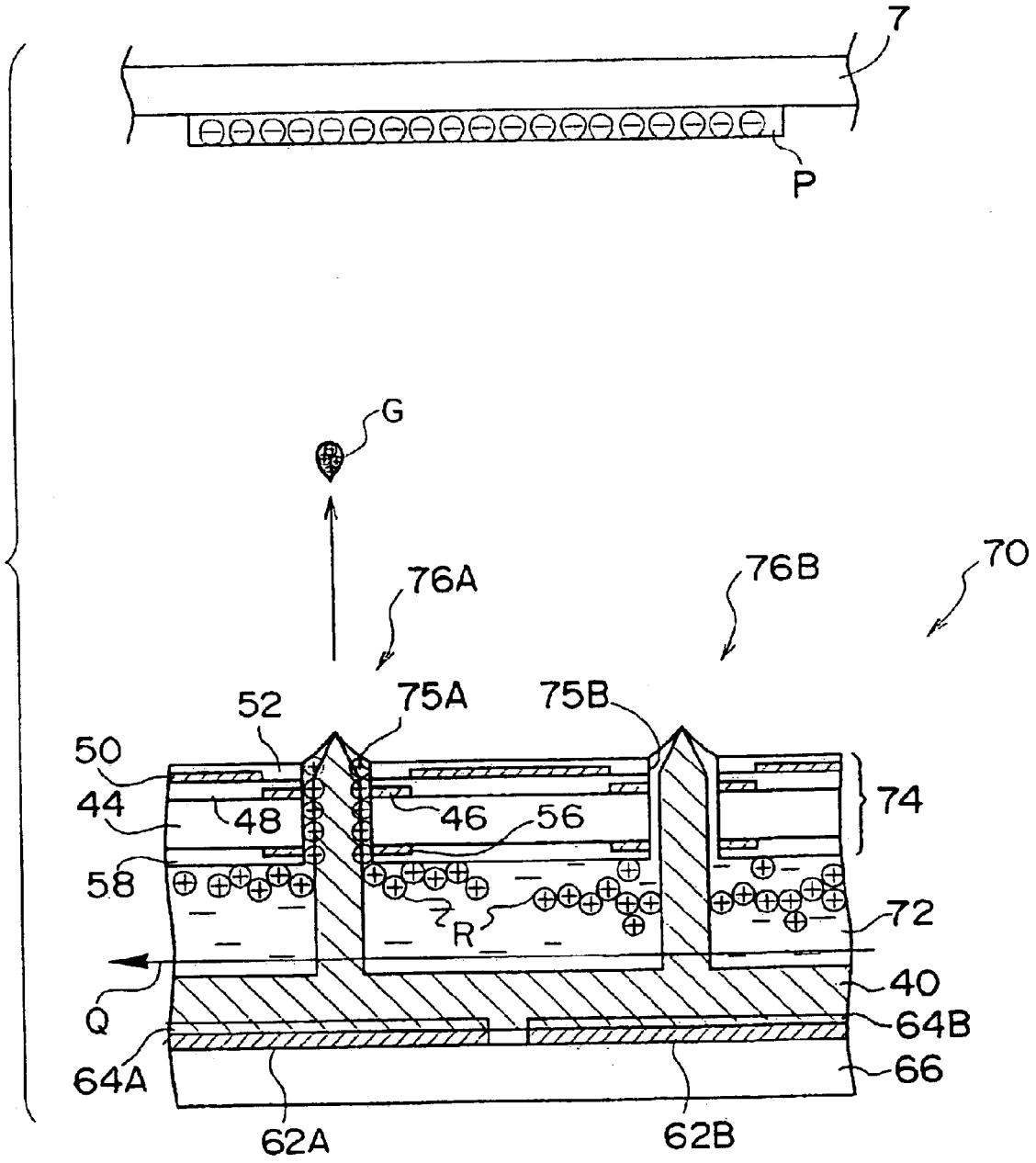
FIG. 19 is a side sectional view showing another variant example of an inkjet head, which applies the present invention.

As shown in FIG. 19, the floating conduction plate 62 may have a structure, which is, sectioned in correspondence with the respective discharge portions, the sections being electrically isolated. (In FIG. 19, neighboring floating conduction plate sections 62A and 62B are insulated from one another.) When such a structure is used, effects due to voltages applied at neighboring discharge portions can be reduced. That is, at a time at which the discharge portion 76A of the inkjet head 70 is being used and the discharge portion 76B is not being used, a high induced voltage is generated at the floating conduction plate section 62A of the discharge portion 76A and an induced voltage lower than that at the floating conduction plate section 62A is generated at the floating conduction plate section 62B of the discharge portion 76B. Consequently, more of the charged particles gather at the vicinity of the opening 75A, and the charged particles are less likely to gather at the vicinity of the opening 75B. Hence, prevention of clogging of the opening 75B at the ink downstream side of the discharge portion 76B can be implemented more efficiently, and the ink density at the vicinity of the opening 75A of the discharge portion 76A, which is being used, can be more efficiently raised than in the first mode. At a time when both the neighboring discharge portions 76A and 76B are being used, equivalent induced voltages are generated at each of the floating conduction plate sections 62A and 62B, and the charged particles gather in the vicinities of the opening 75A and the opening 75B.

Figure 20:
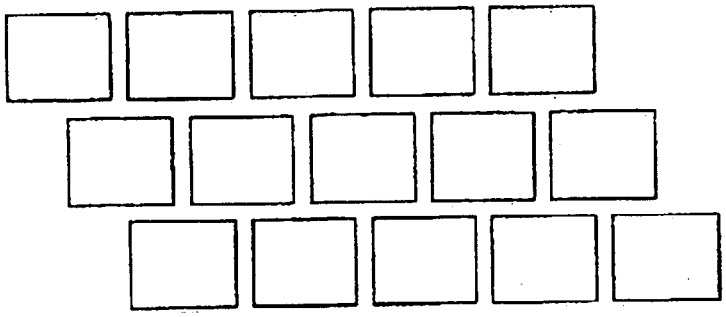
FIG. 20 is a plan view showing an example of floating conduction plates of the inkjet head shown in FIG. 19.
Figure 21:
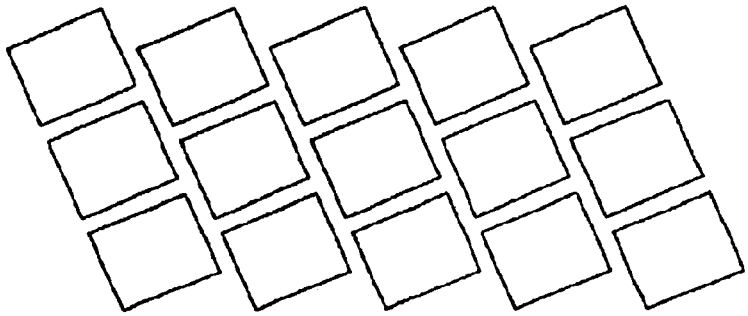
FIG. 21 is a plan view showing an example of floating conduction plates of the inkjet head shown in FIG. 19.
Figure 22:
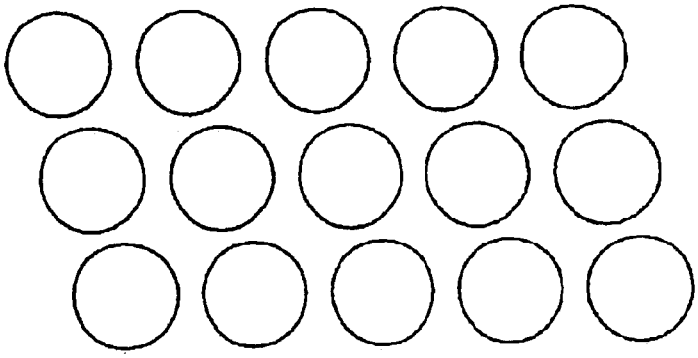
FIG. 22 is a plan view showing an example of floating conduction plates of the inkjet head shown in FIG. 19.

Form and arrangement of the floating conduction plate 62 may have, for example, any of the modes shown in FIGS. 20 to 22. It is preferable if spaces between adjacent floating conduction plate sections are not greatly opened up. Further, although a mode in which one floating conduction plate section is provided in correspondence with one discharge portion has been illustrated for the present mode, modes in which one floating conduction plate section is provided in correspondence with a plurality of discharge portions are also possible.

Hereabove, an example in which colored particles are positively charged has been described. However, it is also possible to use negatively charged colored particles. In such a case, the charging electrodes mentioned above all have the opposite polarities.

In the above description, a case in which the discharge electrodes have the same polarity as the colored particles and the recording medium P has the opposite polarity to the colored particles has been described. However, as long as an electric field that moves the colored particles in a direction towards the recording medium is generated, the polarities of the discharge electrodes and the recording medium are not limited to the above. That is, it is possible to set the discharge electrodes to the same polarity as the colored particles and set the recording medium P to the same polarity as the colored particles, or to not charge the recording medium P.

It is also possible to set the discharge electrodes to the opposite polarity to the colored particles and set the recording medium P to the opposite polarity to the colored particles. Furthermore, it is also possible to set the discharge electrodes to 0 V and set the recording medium to the opposite polarity to the colored particles.

Of the cases described above, in cases in which the recording medium is charged to the same polarity as the colored particles and cases in which the recording medium is not charged, there is no charge on the recording medium with an opposite polarity to the colored particles. Thus, the colored particles are not attracted to positions of the recording medium at which image formation is not desired, and smearing can be prevented. Further, in cases in which the discharge electrodes are negatively charged, a negative charge voltage application driver can be used as the head driver. Negative charge voltage application drivers are produced in a greater variety of types for general use and are lower in cost than positive charge voltage application drivers. Therefore, an increase in selection options of the head driver and a reduction in costs can be expected.

Figure 23:
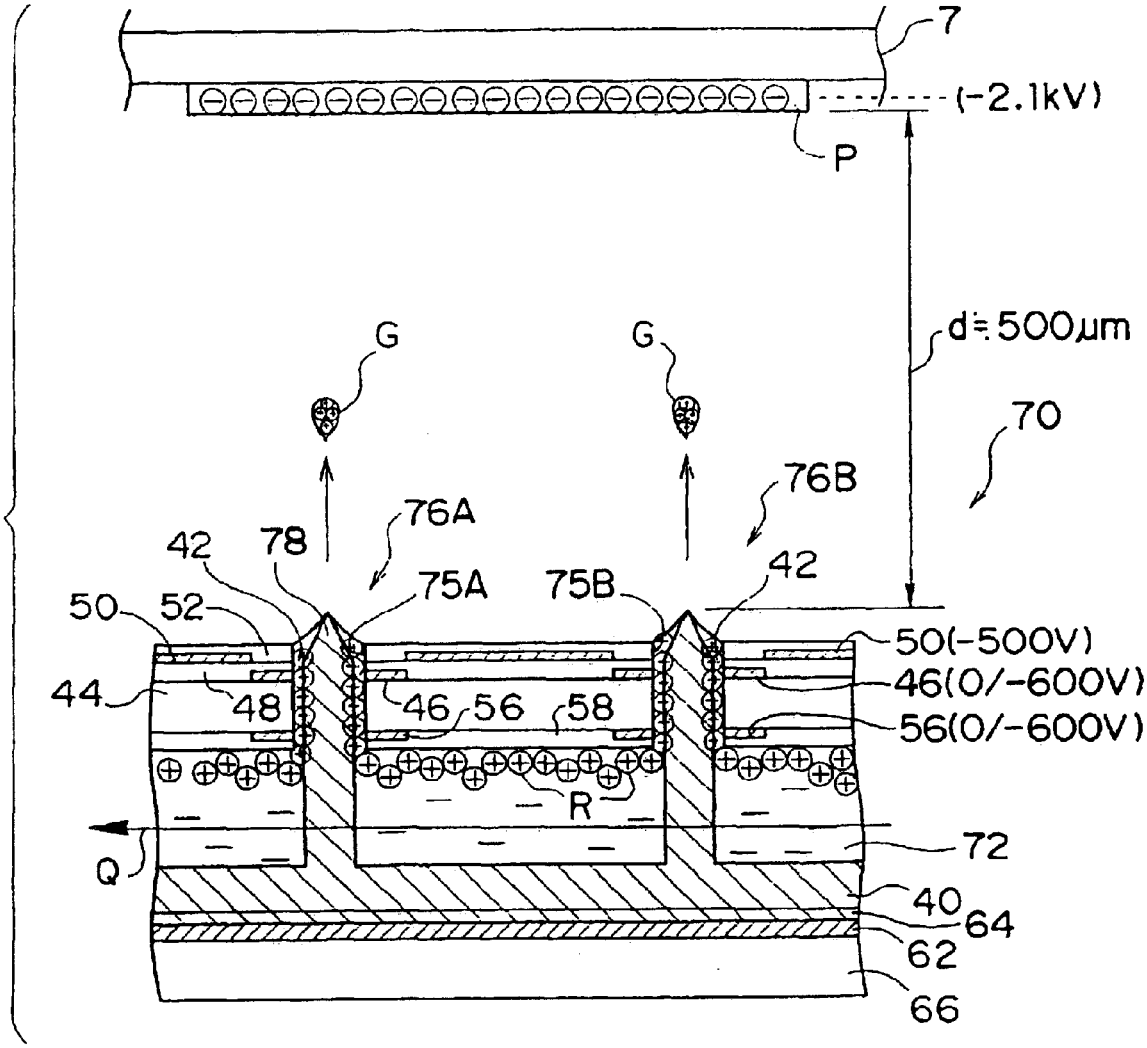
FIG. 23 is a diagram showing an example of operation of the inkjet recording device shown in FIG. 14.

In a case in which image formation is carried out with the colored particles being positively charged and the discharge electrodes and recording medium P being negatively charged, the following is possible. First, an electric field from the recording medium P which causes discharge of ink droplets due to electrostatic force (whose field strength is at least $2.0\times10^7$ V/m and preferably at least $2.5\times10^7$ V/m) is continuously formed at the discharge portion 76 of the inkjet head 70. Then discharge is controlled by applying a negative charge to at least one of the first discharge electrode 46 and the second discharge electrode 56 so as to set the electric field strength at the discharge portion 76 to a range which does not cause discharge of ink droplets (i.e., not more than $1.5\times10^7$ V/m, and preferably not more than $1.0\times10^7$ V/m). Thus, image formation on the recording medium P is carried out. For example, as shown in FIG. 23, in a case in which the gap d between the recording medium P and the discharge portion 76 is about 500 $\mu$m, the recording medium P is set to −2.1 kV, the guard electrode is set to −500 V, the floating electrode plate is set to an electrically floating state, and the first and second discharge electrodes are set to −600 V. Hence, the control described above can be implemented by setting both the first discharge electrode and the second discharge electrode to 0 V when discharge of an ink droplet is to be carried out.

Next, a recording medium to be utilized for the present invention is described. Examples of the recording medium include high quality papers, micro-coated papers and coated papers which are commonly used printing papers. Further, papers having a resin film layer at the surface thereof, for example, polyolefin laminated paper, and plastic films such as, for example, polyester films, polystyrene films, vinyl chloride films, polyolefin films and the like can be used. Further still, a plastic film or processed paper at whose surface a metal is vapor-deposited or a metallic foil is adhered can also be used. Dedicated inkjet papers and dedicated inkjet films can also be used.

EXAMPLES

Example 1

In an inkjet recording device as shown in FIG. 1, ink tanks connected to four respective heads were filled with four inks. (For the inks, positively charged colored particles with average diameters of 0.7 to 1.0 $\mu$m were dispersed in ISOPAR G. Carbon black, phthalocyanine blue, CI pigment red and CI pigment yellow were used as pigments for the colored particles.) A 150 dpi 833-channel head (with channels arranged in three staggered rows at channel densities of 50 dpi) of the type shown in FIG. 9 was used as a discharge head, and a silicon rubber heat roller in which a 1 kw heater was incorporated was used as a fixing component. Immersion heaters and stirring vanes were provided in the ink tanks to serve as ink temperature management components. The ink temperature was set to 30° C., the stirring vanes were rotated at 30 rpm and the temperature was controlled with a thermostat. The stirring vanes were used as stirring components for preventing precipitation and coagulation. The ink channels were made partially transparent, and LED light emission elements and light detection elements were disposed sandwiching the transparent portions of the ink channels. Concentration of the ink was managed by addition of an ink dilution fluid (ISOPAR G) or of concentrated ink (with a density of solid components adjusted to twice that of the ink described above) in accordance with output signals from the light detection elements. Removal of dust from a recording medium surface was carried out by suction of an air pump, after which the discharge head was brought close to the recording medium at an image formation position. Image data that was to be printed was transmitted to an image data calculation control section and, while the recording medium was transported in accordance with rotation of a transport belt, the discharge head was moved in steps and the oil-based inks formed an image with a picture definition of 2400 dpi. As the transport belt, a belt in which a metal belt and a polyimide film had been stuck together was used. A line-form marker was provided at one end vicinity of the belt. This mark was optically read by a transport belt position detection component, and a position control component carried out driving for forming the image. At this time, in accordance with output from an optical gap detection apparatus, the separation of the discharge head and the recording medium was kept at 0.5 mm. At times of discharge, positions at the surface of the recording medium were set to −1.8 kV, and at times at which discharge was to occur, pulse voltages of +500 V (pulse width 50 $\mu$s) were applied. Image formation was carried out at a driving frequency of 15 kHz. Image formation problems and the like were not observed at all, and image deterioration due to variations in dot diameters and the like because of ambient temperature variations and increases in printing duration was not observed at all. Thus, excellent printing was possible.

After printing was finished, in order to protect the inkjet head, the inkjet recording device was withdrawn 50 mm from a position near an image formation drum.

Printed matter that was obtained had extremely clear images, which were free of linear unevenness and smearing. For 10 minutes after printing, ISOPAR G was supplied to the head instead of ink, for cleaning, and then the head was accommodated at a cover, which was charged with ISOPAR G vapor. Thus, excellent printing matter could be produced over three months without special conservation operations.

Example 2

In an inkjet recording apparatus as shown in FIG. 7, a 200 dpi 601-channel head (provided with four staggered rows with channel densities of 50 dpi) of the type shown in FIG. 11 was used as a discharge head. A heating roller produced of silicon rubber coated with TEFLON (R), at which a 0.8 kW heater was incorporated, was used as a fixing component. A belt in which a metallic belt had been stuck together with a polyimide film was used as a transport belt. An end portion of this belt was optically read by a transport belt position detection component, and a position control component carried out driving to form an image at 1800 dpi. Image formation was carried out with other conditions set to be the same as in Example 1. Image formation problems due to dust and the like were not observed at all, and image deterioration due to variations in dot diameters and the like because of ambient temperature variations and increases in printing duration was not observed at all. Thus, excellent printing was possible, and the obtained printed material had extremely clear images, which were free of linear unevenness and smearing.

Example 3

A 1200 dpi, 10-inch wide full-line head-type channel head as shown in FIG. 23 was used in the apparatus of FIG. 8. Other conditions were set to be the same as in Example 1, and image formation was carried out. Image formation problems were not observed at all, and image deterioration due to variations in dot diameters and the like because of ambient temperature variations and increases in the numbers of sheets printed was not observed at all. Thus, excellent single-sided and double-sided full-color printing was possible.

After printing was finished, circulation of ISOPAR G at the head was carried out to perform cleaning, and further cleaning was carried out by contacting distal ends of the head with a non-fibrous cloth including ISOPAR G. Thus, excellent printed material was produced over three months without any need for conservation operations. Furthermore, when a discharge failure occurred at a nozzle, interpolation was implemented by the other nozzles using the method described earlier, without deliberate cleaning being carried out. As a result of using adjacent nozzles as substitute nozzles (based on output of the transport belt position detection component, the image-forming component was controlled such that superposition printing was offset by 21.1 $\mu$m, corresponding to a pitch of 1200 dpi), although productivity was halved, printed matter without image defects could be obtained.

What is claimed is:

1. An inkjet recording device comprising:

an image-forming component which discharges ink from a discharge head onto a recording medium on the basis of image data, so as to form an image;

a transport component which is provided with a transport belt retaining the recording medium at a predetermined position thereon, and which transports the recording medium in a longitudinal direction of the transport belt;

a position detection component which detects at least one of a relative position of the transport belt in a width direction thereof with respect to the image-forming component, and a relative position of the recording medium with respect to the image-forming component; and a position alteration component which alters a Position of image formation by the image-forming component in accordance with the relative position detected by the position detection component, wherein:

the position detection component detects a position of at least one of the transport belt and the recording medium retained at the transport belt, with respect to the width direction of the transport belt; and the position alteration component controls a position of the image-forming component with respect to the width direction of the transport belt, in accordance with the position detected by the position detection component.

2. The inkjet recording device of claim 1, wherein the transport belt is endless.

3. The inkjet recording device of claim 1, wherein the transport component transports the recording medium in at least one of a main scanning direction and a sub-scanning direction of image formation by the image-forming component.

4. The inkjet recording device of claim 1, wherein the discharge head has a plurality of nozzles disposed from one end of an image forming region to another end of the image forming region in the width direction of the transport belt.

5. The inkjet recording device of claim 1, wherein the ink is an oil-based ink, and the discharge head uses an electrostatic field to discharge the oil-based ink.

6. The inkjet recording device of claim 1, wherein the discharge head has a plurality of nozzles arranged in the width direction of the transport belt, the inkjet recording device further comprising:

a discharge defect nozzle detection component which, in a case in which an ink discharge defect occurs at one or more nozzles among the plurality of nozzles, detects the one or more nozzles at which the discharge defect has occurred; and an interpolation processing component which substitutes image formation by the one or more nozzles at which the discharge defect has occurred with image formation by one or more other nozzles at which a discharge defect has not occurred.

7. The inkjet recording device of claim 6, wherein the position alteration component moves the image-forming component in at least one of the longitudinal direction of the transport belt and the width direction of the transport belt in order to carry out image formation using a nozzle at which a discharge defect has not occurred, in place of the nozzle detected by the discharge defect nozzle detection component.

8. The inkjet recording device of claim 6, wherein the discharge defect of the nozzle comprises at least one of an ink discharge failure, a discharge amount abnormality and a discharge direction abnormality.

9. An inkjet recording method comprising the steps of:

retaining a recording medium at a predetermined position on a transport belt which is disposed at a position facing an image-forming component having a discharge head, and transporting the recording medium in a longitudinal direction of the transport belt;

detecting at least one of a relative position of the transport belt in a width direction thereof with respect to the image-forming component, and a relative position of the recording medium with respect to the image-forming component;

altering a position of image formation by the image-forming component in accordance with the detected relative position; and discharging ink from the discharge head on the basis of image data, so as to form an image, wherein:

a position of at least one of the transport belt and the recording medium with respect to the width direction of the transport belt is detected; and a position of the image-forming component is moved in the width direction of the transport belt in accordance with the detected position.

10. The inkjet recording method of claim 9, wherein the transport belt is endless.

11. The inkjet recording method of claim 9, wherein a direction in which the recording medium is transported in the longitudinal direction of the transport belt is at least one of a main scanning direction and a sub-scanning direction of image formation by the image-forming component.

12. The inkjet recording method of claim 9, wherein the discharge head has a plurality of nozzles disposed from one end of an image forming region to another end of the image forming region in the width direction of the transport belt.

13. The inkjet recording method of claim 9, wherein the ink is an oil-based ink, and the discharge head uses an electrostatic field to discharge the oil-based ink.

14. The inkjet recording method of claim 9, wherein the discharge head has a plurality of nozzles arranged in the width direction of the transport belt, the inkjet recording method further comprising the steps of:

in a case in which an ink discharge defect occurs at one or more nozzles among the plurality of nozzles, detecting a nozzle at which the discharge defect has occurred; and carrying out image formation using other one or more nozzles at which a discharge defect has not occurred, in place of the one or more nozzles at which the discharge defect has occurred.

15. The inkjet recording method of claim 14, wherein the image-forming component is moved in at least one of the longitudinal direction of the transport belt and the width direction of the transport belt in order to carry out image formation using a nozzle at which a discharge defect has not occurred, in place of the nozzle at which the discharge defect has occurred.

16. The inkjet recording method of claim 14, wherein the discharge defect of the nozzle comprises at least one of an ink discharge failure, a discharge amount abnormality and a discharge direction abnormality.

* * * * *